US006578562B1

(12) United States Patent
Aljabari et al.

(10) Patent No.: US 6,578,562 B1
(45) Date of Patent: Jun. 17, 2003

(54) HIGH SPEED CARBURETION SYSTEM FOR COMPRESSED AIR ASSISTED INJECTION

(75) Inventors: Samer Aljabari, Charlotte, NC (US); Scott R. Shaw, Brentwood, TN (US)

(73) Assignee: Homelite Technologies, Ltd., Hamilton (BM)

( * ) Notice: Subject to any disclaimer, the term of this patent is extended or adjusted under 35 U.S.C. 154(b) by 0 days.

(21) Appl. No.: 09/518,578

(22) Filed: Mar. 3, 2000

Related U.S. Application Data

(60) Provisional application No. 60/125,029, filed on Mar. 18, 1999, provisional application No. 60/125,648, filed on Mar. 22, 1999, and provisional application No. 60/133,286, filed on May 10, 1999.

(51) Int. Cl.[7] ..... F02B 13/00

(52) U.S. Cl. ..... 123/582; 123/73 PP

(58) Field of Search ..... 123/582, 581, 123/586, 73 A, 73 B, 73 BA, 73 PP; 261/23.2, 40, 41.2, 41.3

(56) References Cited

U.S. PATENT DOCUMENTS

| | | | | | |
|---|---|---|---|---|---|
| 1,552,995 | A | * | 9/1925 | McKenzie-Martyn | 123/582 |
| 2,315,882 | A | * | 4/1943 | Trimble et al. | 123/582 |
| 2,460,046 | A | * | 1/1949 | Vincent | 123/582 |
| 2,616,404 | A | * | 11/1952 | Bartholomew | 123/582 |
| 3,265,050 | A | | 8/1966 | Tuckey | 123/119 |
| 3,743,254 | A | | 7/1973 | Tuckey | 261/34 A |
| 3,765,657 | A | * | 10/1973 | Du Bois | 261/37 |
| 3,850,153 | A | * | 11/1974 | Sigwald | 123/582 |
| 3,972,324 | A | * | 8/1976 | Marsee | 123/582 |
| 3,980,052 | A | * | 9/1976 | Noguchi et al. | 123/3 |
| 4,103,657 | A | * | 8/1978 | Minami | 123/683 |
| 4,114,374 | A | * | 9/1978 | Tanahashi | 123/582 |
| 4,114,572 | A | * | 9/1978 | Matsuda et al. | 123/582 |
| 5,503,119 | A | | 4/1996 | Glover | 123/73 B |
| 6,484,695 | B1 | * | 11/2002 | Cobb, Jr. | 123/438 |

* cited by examiner

*Primary Examiner*—Henry C. Yuen
(74) *Attorney, Agent, or Firm*—Harrington & Smith, LLP

(57) ABSTRACT

An internal combustion engine having a crankcase, a cylinder connected to the crankcase, a compressed air assisted fuel injection system connected between the crankcase and the cylinder, and a reciprocating piston head located in the cylinder. The improvement comprises a fuel delivery system having two carburetors that switch delivery of fuel to two different locations based upon the speed of the engine. The system uses an accumulator with piston ported reflected compression wave delivery of scavenged compressed air to deliver fuel at a wide open throttle position.

40 Claims, 17 Drawing Sheets

HIGH SPEED CARBURETION SYSTEM FOR COMPRESSED AIR ASSISTED INJECTION

CROSS-REFERENCE TO RELATED APPLICATIONS

This application claims the benefit of U.S. provisional patent application Nos. 60/125,029 filed Mar. 18, 1999, 60/125,648 filed Mar. 22, 1999, and 60/133,286 filed May 10, 1999.

BACKGROUND OF THE INVENTION

1. Field of the Invention

The present invention relates to internal combustion engines and, more particularly, to a carburetion system for compressed air assisted injection.

2. Prior Art

The present invention relates to fuel injection systems for internal combustion engines and, more specifically, to the control of a low pressure injection in an internal combustion engine. A particular field of application of the invention is a two-stroke internal combustion engine. The specific application described is to a small high speed two-stroke engine, such as utilized in handheld power equipment such as leaf blowers, string trimmers and hedge trimmers, also in wheeled vehicle applications such as mopeds, motorcycles and scooters, and in small outboard boat engines. The small two-stroke engine has many desirable characteristics, that lend themselves to the above applications, including: simplicity of construction, low cost of manufacturing, high power-to-weight rations, high speed operational capability and, in many parts of the world, ease of maintenance with simple facilities.

The prominent drawback of the simple two-stroke engine is the loss of a portion of the fresh unburned fuel charge from the cylinder during the scavenging process. This leads to poor fuel economy and, most importantly, high emission of unburned hydrocarbon, thus rendering the simple two-stroke engine incapable of compliance with increasingly stringent governmental pollution restrictions. This drawback can be relieved by separating the scavenging of the cylinder, with fresh air, from the charging of the cylinder, with fuel. This separation can be achieved by injecting the liquid fuel into the cylinder or more preferably by injecting the fuel charge by utilizing a pressurized air source, separate from the fresh air scavenge, to spray the fuel into the cylinder. In a preferred embodiment of the present invention, the displacement size of the engine is about 16 cc to about 100 cc, but could be larger or smaller. These sizes of engines are used for such things as string trimmers, chain saws, leaf blowers, and other hand held power tools. The engine could be also be used on a tool such as a lawn mower, snow blower or motor boat outboard engine.

SUMMARY OF THE INVENTION

In accordance with one embodiment of the present invention, an internal combustion engine is provided having a crankcase, a cylinder connected to the crankcase, a compressed air assisted fuel injection system connected between the crankcase and the cylinder, and a reciprocating piston head located in the cylinder. The improvement comprises a fuel delivery system having two carburetors that switch delivery of fuel to two different locations based upon the speed of the engine. The system uses an accumulator with piston ported reflected compression wave delivery of scavenged compressed air to deliver fuel at a wide open throttle position.

In accordance with another embodiment of the present invention, a carburetor system for use with an internal combustion engine is provided comprising a frame forming two air conduits; a fuel metering device connected to the frame for delivering fuel to the two air conduits; and a fuel delivery varying system for varying amounts of fuel delivered from the fuel metering device to the two air conduits when speed of the engine or load on the engine changes. The fuel delivery varying system is adapted to increase fuel delivery to a first one of the air channels with a substantially simultaneous decrease in fuel delivery to a second one of the air channels.

In accordance with one method of the present invention, a method of delivering fuel in a carburetor to an internal combustion engine is provided comprising steps of: delivering fuel to a first air channel of the carburetor; delivering fuel to a second air channel of the carburetor; and decreasing fuel delivery to the first air channel when fuel delivery is increased to the second air channel; wherein fuel is delivered through the first and second air channels to two respective spaced locations for delivery to a same cylinder of the engine, and wherein a flow rate and piston cycle of fuel delivery to a first one of the spaced locations through the first air channel is decreased as a flow rate per piston cycle of fuel delivery to a second one of the spaced locations through the second air channel is increased.

In accordance with another method of the present invention, a method of delivering fuel in a carburetor to a two-stroke internal combustion engine is provided comprising steps of: delivering fuel to a fuel and air delivery channel in the carburetor; and varying an amount of fuel being delivered to the fuel and air delivery. channel based, at least partially, upon suction generated by air being pulled through a main air channel of the carburetor into a crankcase of the engine, wherein substantially all the fuel in the fuel and air delivery channel is introduced into a combustion chamber of the engine without passing through the crankcase.

In accordance with another embodiment of the present invention, an internal combustion engine is provided having a crankcase, a cylinder connected to the crankcase, a compressed air assisted fuel injection system connected between the crankcase and the cylinder, and a reciprocating piston head located in the cylinder. The improvement comprises a fuel delivery system having two carburetors with a throttle shaft extending into the two carburetor sections.

In accordance with another embodiment of the present invention, a carburetor system for use with an internal combustion engine is provided comprising a first carburetor section; a second carburetor section; and a common throttle shaft assembly extending through both the first and second carburetor sections. The shaft assembly comprises a throttle plate located in a main air passageway of the first carburetor section and a throttle shaft having the throttle plate connected thereto. The throttle shaft extends into a channel in the second carburetor section and is rotatable to increase and decrease a flow path through the channel as the shaft is rotated.

In accordance with another method of the present invention, a method of controlling delivery of fuel/air mixtures in a carburetor system for an internal combustion engine is provided comprising steps of providing the carburetor system with two carburetor sections for creating two different fuel/air mixtures and a common control shaft assembly which extends through two separate conduits in the respective two carburetor sections; and rotating the common control shaft assembly to open or restrict pathways through the two conduits, wherein a first one of the conduits is smaller than a second one of the conduits, and wherein the control shaft comprises a plate attached to the control shaft in the first conduit and a hole through the control shaft at the second conduit, wherein the hole can be aligned with and misaligned with the second conduit when the control shaft is rotated to open or restrict the pathway through the hole and the second conduit.

In accordance with another embodiment of the present invention, an internal combustion engine is provided having a crankcase, a cylinder connected to the crankcase, a compressed air assisted fuel injection system connected between the crankcase and the cylinder, and a reciprocating piston head located in the cylinder. The improvement comprises a fuel delivery system having two carburetor sections with a throttle shaft assembly and a choke shaft assembly operably connected to two air flow channels of the two carburetor sections.

BRIEF DESCRIPTION OF THE DRAWINGS

The foregoing aspects and other features of the present invention are explained in the following description, taken in connection with the accompanying drawings, wherein:

FIG. 6B is a cross-sectional view of the shaft shown in

FIG. 6A taken along line 6B—6B;

DETAILED DESCRIPTION OF THE PREFERRED EMBODIMENTS

Figure 1C:
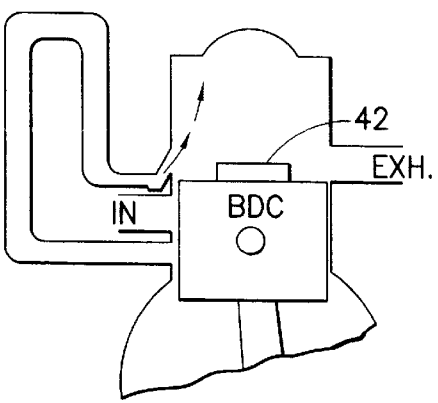
FIGS. 1A–1E are partial schematic diagrams of an engine incorporating features of the present invention with the piston head at various different operational positions.
Figure 1B:
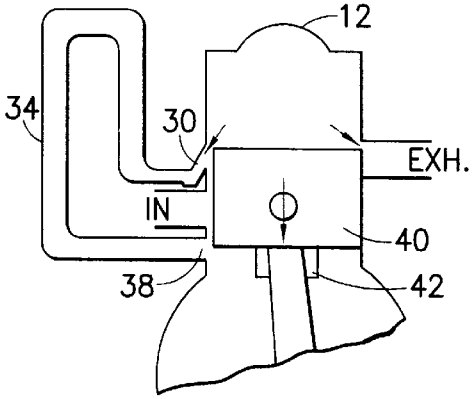
Figure 1E:
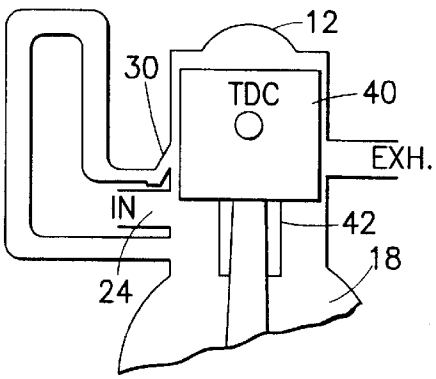
Figure 1D:
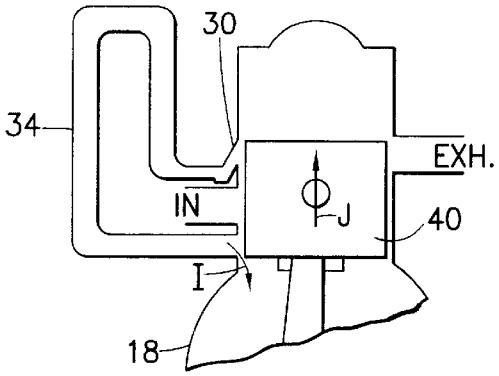
Figure 1A:
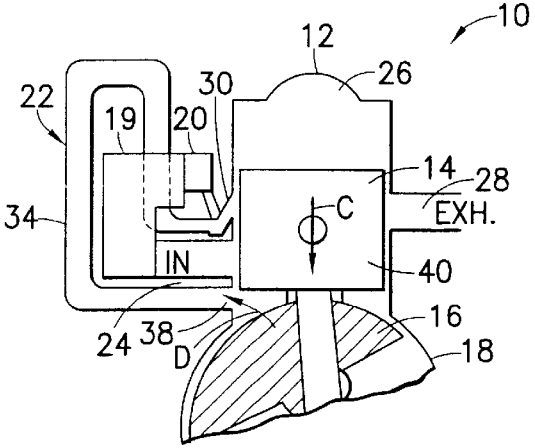

Referring to FIG. 1A, there is shown a schematic view of an internal combustion engine 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The engine 10 is a two-stroke engine having a cylinder 12, a piston 14, a crankshaft 16, a crankcase 18, and a fuel delivery system 22 having a first carburetor 19, a second carburetor 20, and an accumulator 34. The present invention relates to the control of a low pressure injection in an internal combustion engine. A particular field of application of the invention is a two-stroke internal combustion engine. The specific application described is to a small high speed two-stroke engine, such as utilized in handheld power equipment such as leaf blowers, string trimmers and hedge trimmers, also in wheeled vehicle applications such as mopeds, motorcycles and scooters and in small outboard boat engines. The small two-stroke engine has many desirable characteristics that lend themselves to the above applications including: simplicity of construction, low cost of manufacturing, high power-to-weight ratios, high speed operational capability and, in many parts of the world, ease of maintenance with simple facilities.

The prominent drawback of the simple two-stroke engine is the loss of a portion of the fresh unburned fuel charge from the cylinder during the scavenging process. This leads to poor fuel economy and, most importantly, high emission of unburned hydrocarbon, thus rendering the simple two-stroke engine incapable of compliance with increasingly stringent governmental pollution restrictions. This drawback can be relieved by separating the scavenging of the cylinder, with fresh air, from the charging of the cylinder, with fuel. This separation can be achieved by injecting the liquid fuel into the cylinder or more preferably by injecting the fuel charge by utilizing a pressurized air source, separate from the fresh air scavenge, to spray the fuel into the cylinder. This type of method is disclosed in U.S. patent application Ser. No. 09/138,244 filed Aug. 21, 1998 and U.S. patent application Ser. No. 09/504,056 filed Feb. 14, 2000 which are hereby incorporated by reference in their entireties. In a preferred embodiment of the present invention, the displacement size of the engine is about 16 cc to about 100 cc, but could be larger or smaller. These sizes of engines are used for such things as string trimmers, chain saws, leaf blowers, and other hand held power tools. The engine could also be used on a tool such as a lawn mower, snow blower or motor boat outboard engine. The cylinder 12 has a spark plug (not shown) connected to its top, a bottom which is connected to the crankcase 18, an inlet 24, a combustion chamber 26, an exhaust outlet 28, and an injection port or inlet 30 into the combustion chamber. An advantage of the present system is that there is no need for high precision timing or spray quality for the fuel delivery system. A relatively simple metering system that delivers drops of fuel can be used. In the embodiment shown in FIG. 1A the injection port 30 is an open type of port; i.e.: with no flow check valve into the combustion chamber 26. However, an alternate embodiment could be provided which has a flows check valve at its injection port, such as disclosed in U.S. patent application Ser. No. 09/065,374 which is hereby incorporated by reference in its entirety. However, any suitable check valve could be used. The injection port 30 is located in a side wall of the cylinder 12 and is shaped to input fuel and air in an upward direction towards the top of the cylinder head. However, in alternate embodiments the inlet 30 could be located in the top of the cylinder head or be shaped to direct fuel towards the top of the piston 14.

The prominent drawback of the simple two-stroke engine is the loss of a portion of the fresh unburned fuel charge from the cylinder during the scavenging process. This leads to poor fuel economy and, most importantly, high emission of unburned hydrocarbon, thus rendering the simple two-stroke engine incapable of compliance with increasingly stringent governmental pollution restrictions. This drawback can be relieved by separating the scavenging of the cylinder, with fresh air, from the charging of the cylinder, with fuel. This separation can be achieved by injecting the liquid fuel into the cylinder or more preferably by injecting the fuel charge by utilizing a pressurized air source, separate from the fresh air scavenge, to spray the fuel into the cylinder. This type of method is disclosed in U.S. patent application Ser. No. 09/138,244 filed Aug. 21, 1998 and U.S. patent application Ser. No. 09/504,056 filed Feb. 14, 2000 which are hereby incorporated by reference in their entireties. In a preferred embodiment of the present invention, the displacement size of the engine is about 16 cc to about 100 cc, but could be larger or smaller. These sizes of engines are used for such things as string trimmers, chain saws, leaf blowers, and other hand held power tools. The engine could also be used on a tool such as a lawn mower, snow blower or motor boat outboard engine. The cylinder 12 has a spark plug (not shown) connected to its top, a bottom which is connected to the crankcase 18, an inlet 24, a combustion chamber 26, an exhaust outlet 28, and an injection port or inlet 30 into the combustion chamber. An advantage of the present system is that there is no need for high precision timing or spray quality for the fuel delivery system. A relatively simple metering system that delivers drops of fuel can be used. In the embodiment shown in FIG. 1A the injection port 30 is an open type of port; i.e.: with no flow check valve into the combustion chamber 26. However, an alternate embodiment could be provided which has a flows check valve at its injection port, such as disclosed in U.S. patent application Ser. No. 09/065,374 which is hereby incorporated by reference in its entirety. However, any suitable check valve could be used. The injection port 30 is located in a side wall of the cylinder 12 and is shaped to input fuel and air in an upward direction towards the top of the cylinder head. However, in alternate embodiments the inlet 30 could be located in the top of the cylinder head or be shaped to direct fuel towards the top of the piston 14.

The fuel delivery system 22 is a compressed air assisted system. The accumulator 34, in this embodiment, has an inlet 38 connectable to pressure inside the crankcase 18 and an exit at the injection port 30. The accumulator 34 functions as a collector and temporary storage area for compressed air. In this embodiment the source of the compressed air is air scavenged from the crankcase 18. The piston 14 compresses the air in the crankcase 18 on the piston's downward stroke. In a preferred embodiment the two apertures 30, 38 are both provided in the cylinder 12; one above the air inlet 24 and one below the air inlet. In the preferred embodiment both apertures 30, 38 are piston ported. In other words, the piston head 40 is sized and shaped to open and close access through the apertures 30, 38 as the piston head 40 reciprocates up and down in the cylinder 12. The accumulator 34, in this embodiment, is a simple channel between the two apertures 30, 38. However, in alternate embodiments more complicated shapes could be provided. The channel 34 could be partially machined into an exterior surface of the cylinder 12 with a cap then being attached to the cylinder to form and enclose the channel 34 with only the two apertures 30, 38. However, the accumulator could be provided in a separate member attached to the cylinder 12. In the preferred embodiment an exit from the second carburetor 20 is located in the channel 34 proximate the injection port 30.

The fuel delivery system 22 uses the piston head 40 to open and close its ports 30, 38. Timing of the opening and closing of the ports 30, 38 will be dependent upon location of the ports along the length of the cylinder 12. Referring to FIGS. 1A–1E the operation of the delivery system will now be described. The two carburetors 19, 20 are not shown in FIGS. 1B–1E merely for the sake of clarity. FIG. 1A shows the piston head 40 at about 90° ATDC (after top dead center) moving downward in the cylinder 12 as shown by arrow C away from the top dead center position of the piston head. The piston head 40 is blocking the inlet 30, the exhaust outlet 28 and the air inlet 24, but the aperture 38 is open. With the piston head 40 moving towards the crankcase 18, air from inside the crankcase 18 is pushed into the accumulator 34 through the aperture 38 as indicated by arrow D. As the piston head 40 moves towards the position illustrated in FIG. 1B, the aperture 30 is beginning to be opened, as the piston head 40 uncovers the aperture 30, and the aperture 38 is beginning to be closed, as the piston head 40 starts to block the aperture 38. The piston head uncovers the inlet 30 at about 115° of rotation of the crankshaft after TDC (ATDC). In this embodiment the piston head 40 completely closes the aperture 38 at about the same time the piston head opens access to the transfer channel 42 (see FIG. 1C) when the transfer 42 opens. The aperture 38 is effectively closed by the piston head 40 substantially entirely while the aperture 30 is open.

The present invention uses the accumulator 34 and the second carburetor 20 to deliver mostly fuel to the combustion chamber similar to that described in U.S. patent application Ser. No. 09/138,244 by vacuum pulling fuel from the second carburetor 20 into the accumulator 34, using compressed air from the crankcase 18 into the accumulator 34, and using a reflected compression wave in the accumulator 34. As the reflected compression wave in the accumulator 34 exits the inlet 30 it causes the fuel and air in the cylinder 12 to be greatly disturbed; in effect functioning as a shock wave. This helps to atomize the fuel and distribute the fuel better in the air. In addition, the reflected compression wave assists in removing fuel droplets that might be adhering to tips or edges of the inlet 30 by surface adhesion or surface tension. The compression wave shocks the fuel off of the surface and into the cylinder 12. The compressed air 44 continues to push out the inlet 30 until the inlet is closed by the piston head again as shown in FIG. 1D. The residual air in the accumulator 34 after the inlet 30 is closed, just after 1D, is still pressurized. The inlet 30 completely closes shortly before the exhaust outlet 28 is closed. The aperture 38 opens at substantially the same time the aperture 30 is closed. However, in alternate embodiments opening of the aperture 38 could be configured to occur before the aperture 30 is closed or, alternatively, after the aperture 30 is closed. The opening of the aperture 38 functions as a blow off port to relieve residual pressure from the compressed air in the accumulator 34 back into the crankcase 18 as shown by arrow I in FIG. 1D. Relieving pressure from the accumulator 34 when the inlet 30 is closed prevents an excessive amount of fuel from being pushed between the piston head 40 and the inside cylinder wall that could otherwise raise hydrocarbon emissions.

With the piston head 40 rising as shown by arrow J in FIG. 1D towards the TDC position, crankcase pressure drops below 1 atmosphere. Thus, when aperture 38 is opened, not only is pressure in the accumulator 34 relieved, but a vacuum pressure is created in the accumulator 34. This vacuum pressure is used to pull fuel from the second carburetor 20 and thus assist in delivering fuel into the accumulator. Referring also to FIG. 1E the piston head 40 is shown at its TDC position. The air inlet 24 was opened.

The first carburetor 19 introduces a fuel/air mixture into the crankcase 18 which is pushed through channel 42 into the combustion chamber. The second carburetor 20 delivers fuel directly into the channel 34 to be entrained or pushed into the combustion chamber 26.

Figure 2:
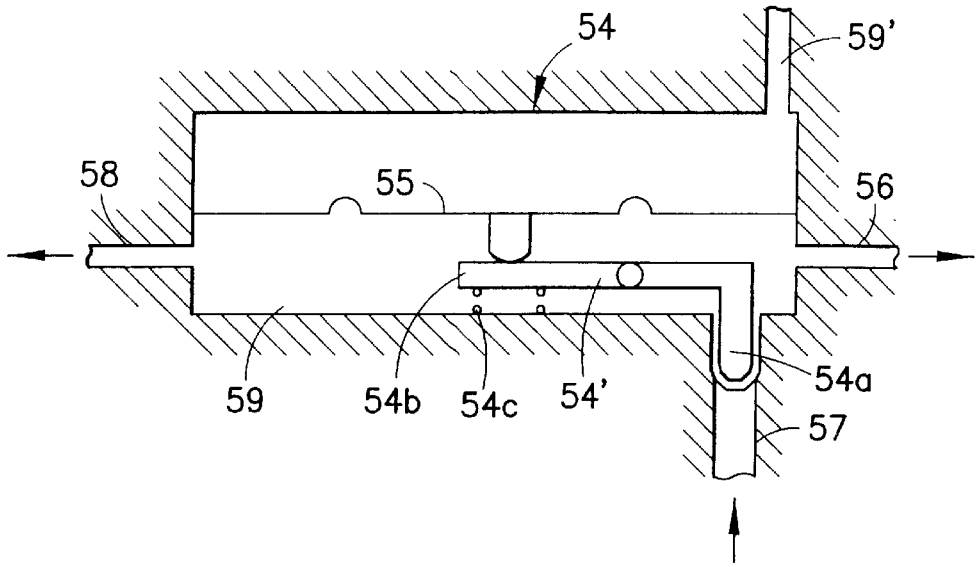
FIG. 2 is a schematic view of the fuel metering system used in the fuel delivery system shown in FIG. 1A.

Referring to FIG. 2, the carburetors 19, 20 have a diaphragm driven fuel metering system 54. What is new with this system is that fuel is delivered by the fuel metering system 54 to two locations. The fuel is delivered to the second carburetor 20 at line 56. Line 58 goes to the main air passage 60 (see FIG. 3A) of the first carburetor 19. In this embodiment the fuel metering system 54 has a diaphragm 55 and a fuel inlet 57. An opposite side of the diaphragm 55 is exposed to atmosphere by hole 59'. A lever 54' is pivotally mounted to the frame with one end 54*a* positioned to open and close the exit from the fuel inlet 57 from the fuel pump and the other end 54*a* biased by a spring 54*c* against the diaphragm 55. Fuel enters chamber 59 for distribution out lines 56 and 58.

Figure 4:
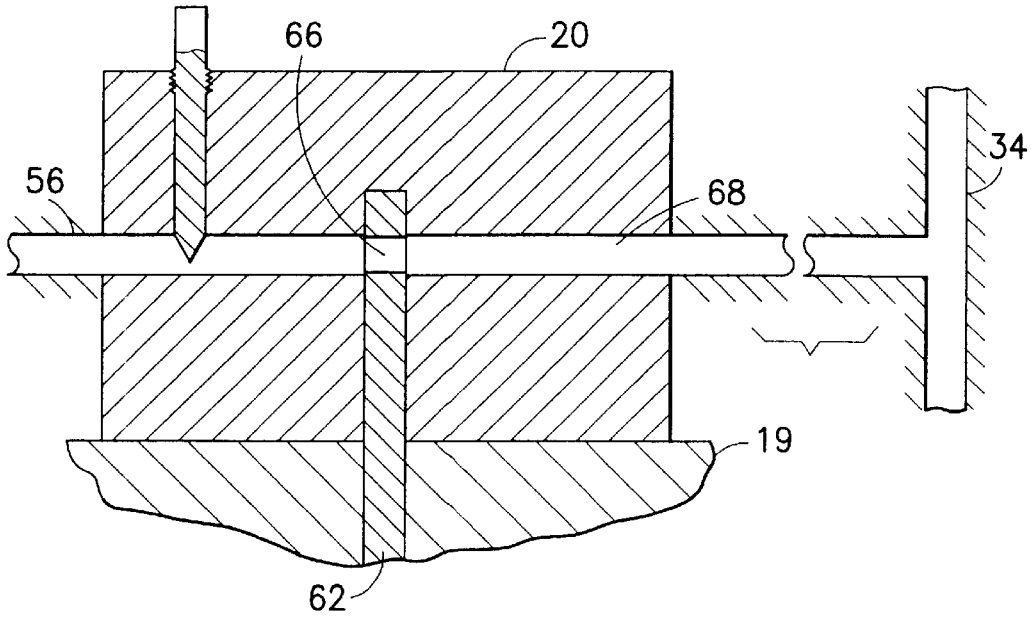
FIG. 4 is a schematic cross-sectional view of the second carburetor connected to the first carburetor.
Figure 3A:
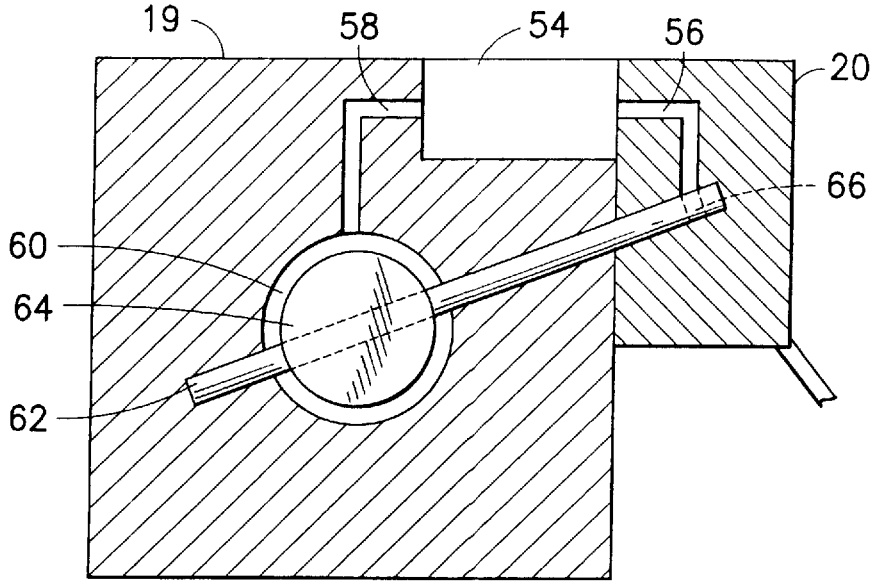
FIG. 3A is a schematic cross-sectional view of a portion of the fuel delivery system shown in FIG. 1A.
Figure 3B:
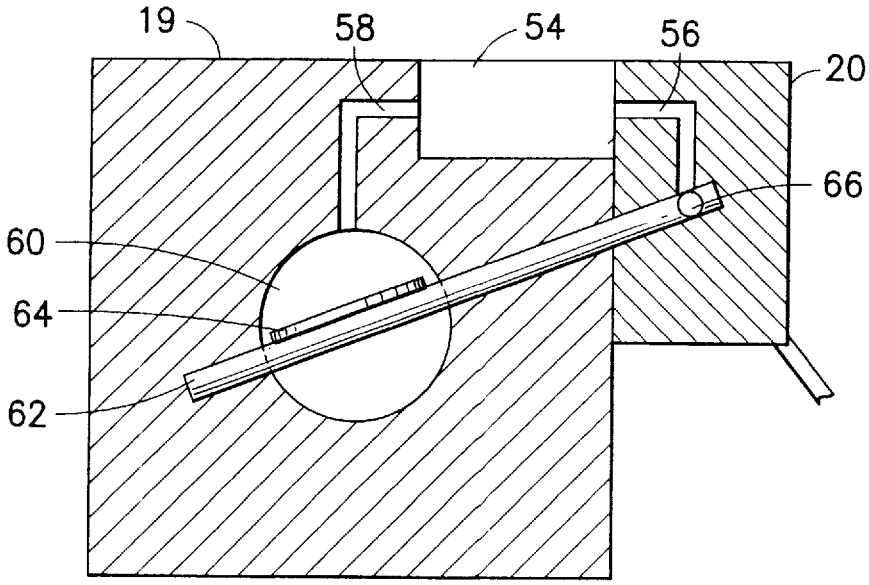
FIG. 3B is a schematic view as in FIG. 3A with its carburetor shaft rotated to a wide open throttle position.

FIG. 3A shows that the second carburetor 20 is attached directly to the first carburetor 19. The first carburetor 19 has a shaft 62 with a carburetor plate 64 located in the main air passage 60. FIG. 3B shows the shaft 62 rotated 75°. The shaft 62 extends into the second carburetor 20 and has a hole 66. As seen from FIGS. 3A, 3B, and 4, when the shaft 62 is rotated the hole 66 can be positioned into two different positions relative to a fuel passage 68; aligned with the passage 68 to provide an open position or not aligned with a passage 68 to provide a closed position. In the aligned open position fuel can flow through the passage 68. In the non-aligned closed position fuel does not flow through the passage 68. In an alternate embodiment, in the non-aligned position a small amount of fuel could be allowed to flow through the passage 68, such as with only a partially non-aligned configuration. This small amount of fuel flow through the passage 68 at idle could be provided such that air is prevented from entering the fuel metering chamber at idle through the passage 68. In an alternate embodiment passage 68 could be a combined fuel and air passage with shaft 62 and hole 66 controlling flow of the fuel/air mixture into the accumulator 34. A check valve could also be provided at the exit of the passage 68 into the accumulator 34.

With the first carburetor 19 in the idle position shown in FIG. 3A, the hole 66 is not aligned with the channel 68. Therefore, no fuel is delivered to the combustion chamber from the second carburetor 20. In the idle position fuel is only delivered by the first carburetor 19, via inlet 24, crankcase 18 and channel 42, to the combustion chamber. When the shaft 62 is rotated to the wide open throttle (WOT) position shown in FIG. 3B, fuel is delivered to the accumulator 34 by the second carburetor 20. In particular, when the shaft 62 is moved to the position shown in FIGS. 3B and 4, fuel is vacuum pulled into the accumulator 34 from the chamber 59 of the metering device 54. Because plate 64 is at an open position, the line 58 is exposed to significantly less vacuum pull. Thus, significantly less fuel is delivered to the main air passage 60 at the wide open throttle position. Almost all the fuel is delivered by the second carburetor 20. Thus, the present invention switches fuel delivery between the first carburetor 19 at idle and the second carburetor 20 at wide open throttle. In an alternate embodiment switching of fuel delivery does not need to be provided, such as in a system that does not draw away fuel between the two carburetors 19, 20. One such alternate embodiment is described below with reference to FIG. 13. In regard to the system which has draw-away fuel switching as in FIGS. 3A, 3B and 4, at wide open throttle a small amount of fuel/oil will pass through the main air passage 60 to lubricate the components in the crankcase 18. During wide open throttle the vacuum in line 56 starves the line 58 of most fuel. A smooth transition is provided as the fuel delivery system switches between idle and wide open throttle conditions. During wide open throttle almost pure air is entering inlet 24 into the crankcase 18. The engine 10 could have an additional or alternative lubrication system.

As is known in the art for small two stroke engines, misfires (i.e.: no combustion in the combustion chamber) can occur as much as one-third of the time. If a misfire occurs in the engine 10 a compression wave will not pass into the accumulator 34. One of the features of the present invention is that the inlet aperture 30 is sized to prevent the accumulator 34 from totally discharging into the cylinder 12. In other words, the accumulator 34 is pressurized for the entire time that the inlet 30 is open such that compressed air is continually exerting pressure out the inlet 30 when the inlet 30 is open. This occurs regardless of whether there has been combustion or a misfire. Since the piston head 40 opens and closes all of the ports/channels 24, 28, 30, 38, 42, the engine 10 can be designed to provide different performance characteristics by changing the positions of the ports/channels 24, 28, 30, 38, 42 relative along the length of the cylinder and/or relative to each other along the length of the cylinder. This can change the timing of how long the accumulator 34 is charged with compressed air from the crankcase, how long the accumulator blows off, how long the accumulator injects into the cylinder, etc. This can also change pressure rate changes, such as if the transfer channel, exhaust outlet or air inlet open sooner or later in the piston cycle.

Figure 5:
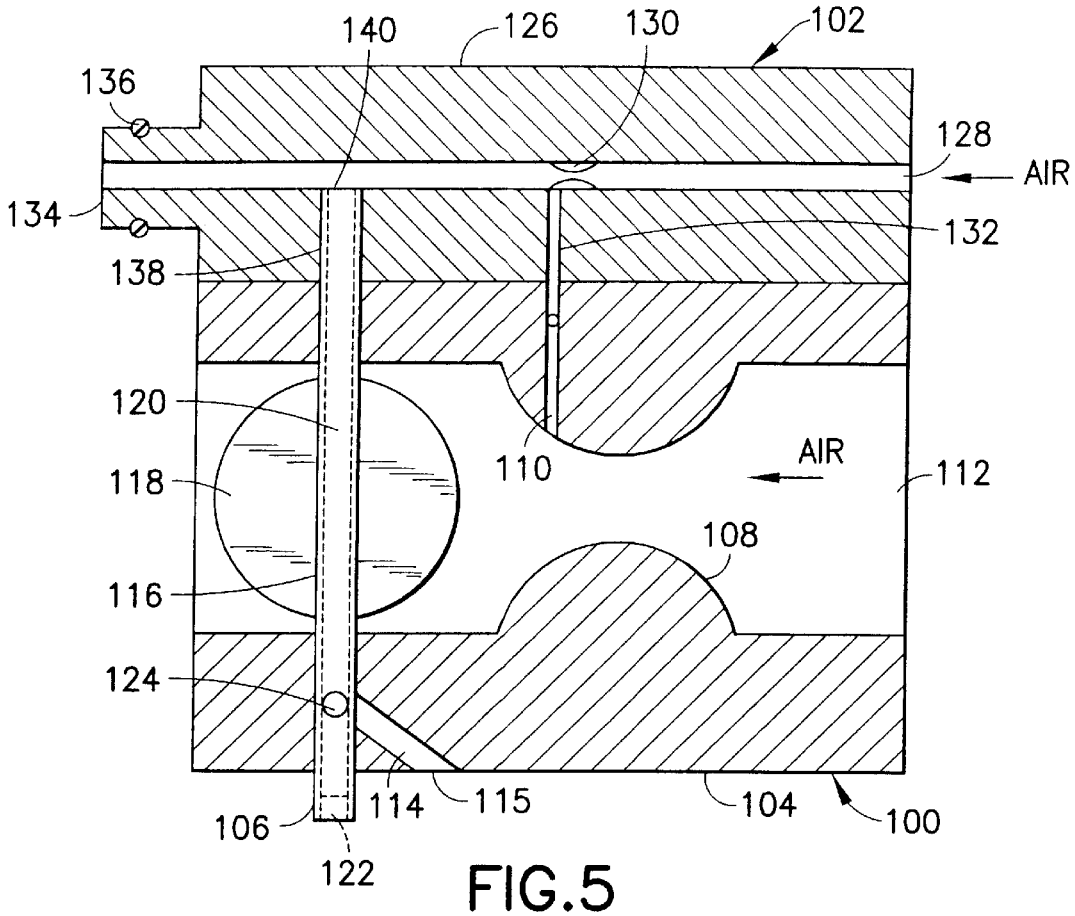
FIG. 5 is a schematic cross-sectional view of an alternate embodiment of a fuel delivery system incorporating features of the present invention.

Referring now to FIG. 5 an alternate embodiment of a fuel delivery system is shown. The system comprises a main carburetor 100 and a secondary carburetor 102. The main carburetor 100 has a frame 104 and a throttle shaft assembly 106. The frame 104 has a venturi 108, a fuel delivery conduit 110, a main air channel 112, and a secondary air channel 114. The throttle shaft assembly 106 has a shaft 116 and a throttle plate 118. In this embodiment the shaft 116 is a tube with a center conduit 120. A plug 122 covers one end of the conduit 120, but the opposite end is open. The shaft 116 also has a hole 124 extending into the conduit 120. The hole 124 is located to move into and out of registry with the secondary air channel 114 as the shaft 116 is rotated between idle and WOT positions. In a preferred embodiment the hole 124 is aligned with the channel 114 at the idle position and not aligned, or substantially out of alignment, with the channel 114 at the WOT position. The opposite end 115 of the channel 114 is exposed to atmosphere such that air can travel through the channel 114 into the conduit 120 when the hole 124 is aligned with the channel 114.

The secondary carburetor 102 comprises a frame 126. The frame 126 is preferably a sandwich plate which is attached to the frame 104. The frame 126 has a main air channel 128, a venturi 130, a fuel supply conduit 132 and a mount 134 with an O-ring seal 136. The two fuel supply conduits 110, 132 are connected to a fuel metering device. The mount 134 is adapted to be mounted in the accumulator 34 (see FIG. 1A) proximate the inlet 30 and main air channel 112 is intended to be mounted to the inlet 24. The frame 126 also has a hole 138. The hole 138 extends from the frame 104 to the air channel 128. An end of the throttle shaft 116 is located in the hole 138 with its open end 140 into the conduit 120 located at the air channel 128. The hole 138 is located downstream from the venturi 130 and fuel supply conduit 132.

To offset a stronger vacuum pull in the air channel 128 at idle than at WOT, atmospheric air is bled into the air channel 128 at idle through the conduit 120. This air bleed lowers the overall vacuum signal at the venturi 130 which reduces the quantity of fuel being introduced into the channel 128 to maintain a proper idle fuel mixture. This air bleed system is turned off when the shaft 116 is rotated to WOT. However, this type of system has shown to have some problems at idle.

Figure 6:
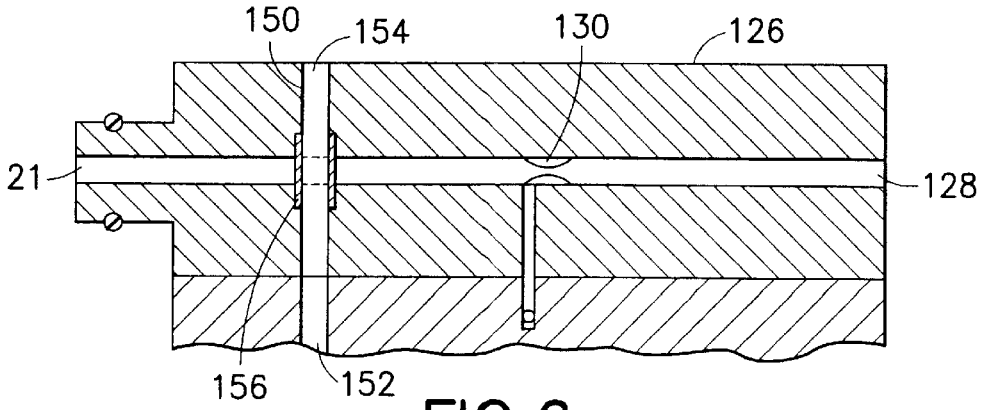
FIG. 6 is a partial schematic cross-sectional view of another alternate embodiment of the fuel delivery system.
Figure 6A:
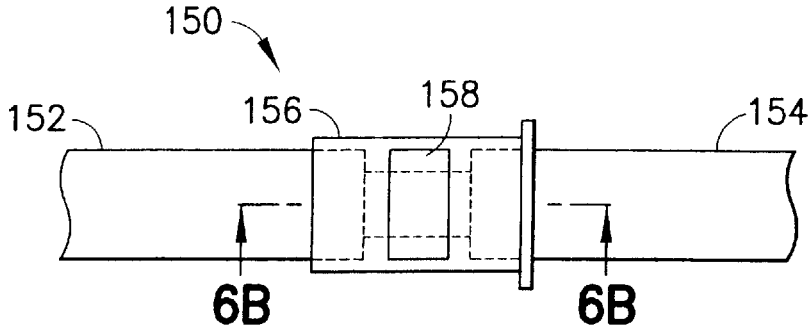
FIG. 6A is an enlarged front elevational view of a portion of the throttle shaft shown in FIG. 6.
Figure 6B:
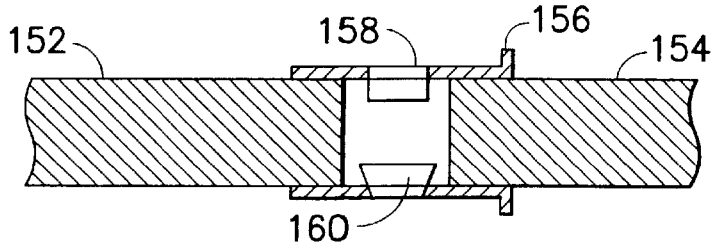
Figure 6C:
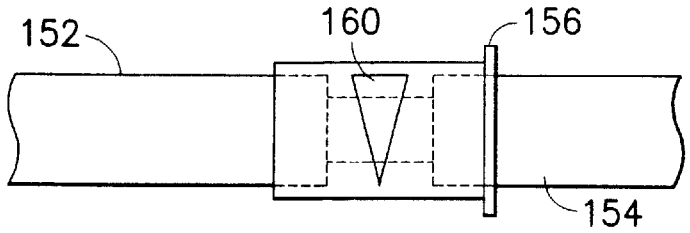
FIG. 6C is a rear elevational view of the portion of the throttle shaft shown in FIG. 6A.

Referring now to FIG. 6 an alternate embodiment is shown. In this embodiment the throttle shaft 150 is an assembly comprising two shaft 152, 154 and a sleeve 156. The sleeve 156 connects the two shafts 152, 154 to each other. The shaft 150 extends across the channel 128 of the frame 126. The sleeve 156 is located in the channel 128. Referring also to FIGS. 6A–6C, the two shafts 152, 154 are solid and the sleeve 156 has a general tube shape. The sleeve 156 has a hollow interior, a first hole 158 on a first side and a second hole 160 on a second side. In this embodiment the first hole 158 has a general rectangular shape and is adapted to move into and out of registry with the channel 128 as the shaft 150 is rotated. At the WOT position the first hole 158 faces the venturi 130. The second hole 160 has a general triangular shape. At the WOT position the second hole 160 faces the inlet 21, into the accumulator. The shape of the hole 160 varies the quantity of air and fuel flowing through sleeve 156 to a predetermined pattern which includes an especially low fuel flow at and near idle. The triangular shape of the hole 160 allows more progressive control over air flow, and thus the fuel flow, through the channel 128 than the simple round hole 66 described with reference to FIGS. 3A, 3B and 4. In alternate embodiments the holes 158, 160 could have any suitable shapes to provide any suitable type of air flow restriction pattern(s).

Figure 7:
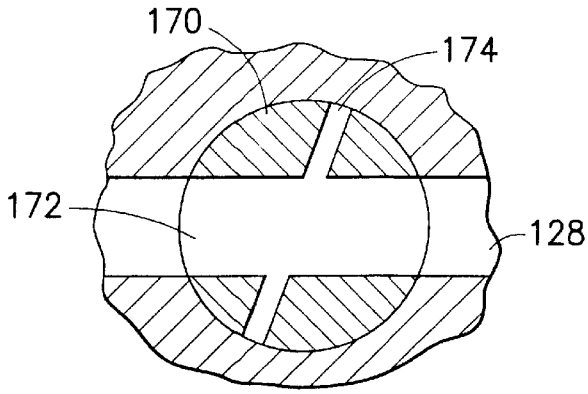
FIG. 7 is a cross-sectional view of an alternate embodiment of the throttle shaft.

Referring now to FIG. 7, an alternate embodiment of throttle shaft 170 located in the main air channel 128 of the secondary carburetor is shown. The throttle shaft 170 has a first hole 172 therethrough and a second hole 174 therethrough. In this embodiment the first hole 172 is larger than the second hole 174 and the two holes intersect each other at an angle. In a preferred embodiment the angle is less than 90° such that, when the shaft 170 is rotated the second hole 174 will come into registry with the channel 128 before the first hole 172 is totally mis-aligned with the channel 128. The use of the second smaller hole 174 being aligned with the channel 128 occurs at idle. Thus, a small amount of air can be vacuum pulled through channel 128 at idle to pull a small amount of fuel from the fuel delivering system and thereby help to prevent air from entering the fuel delivery system and the fuel metering chamber. In an alternate embodiment, rather than the through-hole 174, the throttle shaft could have a small notch or ring machined around its circumference/perimeter. The idle circuit (main carburetor) can also be used to fuel or vacuum pull fuel from the fuel delivery system to the crankcase both at wide open throttle and at idle as a means to prevent air from entering the metering chamber at any time from the idle circuit.

Figure 8:
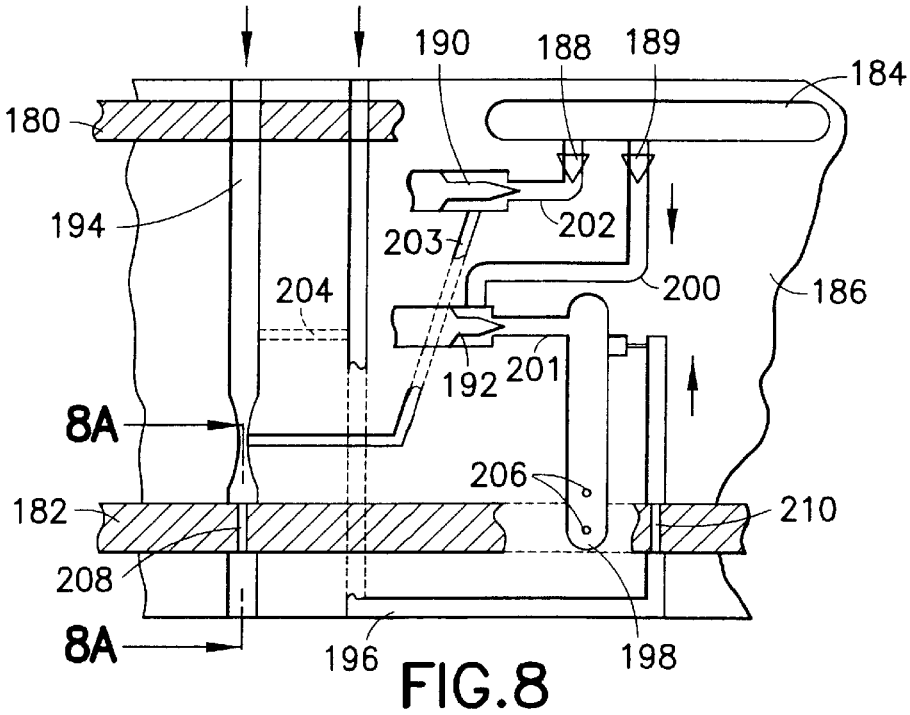
FIG. 8 is a schematic diagram of an alternate embodiment of a fuel distribution system in a carburetor.
Figure 8A:
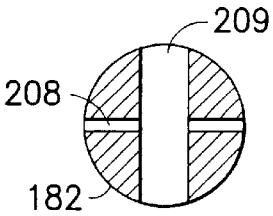
FIG. 8A is a cross-sectional view of the throttle shaft taken along line 8A—8A in FIG. 8.

Referring now to FIG. 8, an alternate embodiment of the fuel delivery system is shown. The system includes a choke shaft 180, a throttle shaft 182, a fuel metering chamber 184, a frame 186, two check valves 188, 189, a high speed fuel needle valve 190, and a low speed fuel needle valve 192. The frame 186 includes various channels including a WOT main air channel 194, an idle main air channel (not shown), an idle secondary air channel 196, an idle pocket 198, and four fuel delivery channels 200, 201, 202, 203. A cross-flow air channel 204 may be provided between the two air channels 194, 196. The idle pocket 198 has holes 206 into the idle main air channel (not shown) which extends into the crankcase. The choke shaft 180 intersects the two air channels 194, 196 and has holes aligned and mis-aligned with the channels 194, 196 based upon rotation of the shaft 180. The throttle shaft 182 also intersects the two air channels 194, 196 based upon rotation of the shaft 182. FIG. 8A shows the two holes 208, 209 which are similar to FIG. 7. FIG. 8A shows an embodiment wherein the shaft 182' has a through-hole 208' and an exterior side groove 209' that intersects the hole 208' proximate the channel 196. When the hole 208' is rotated out of alignment with the channel 196 air can still flow through the groove 209' to allow a reduced, but not completely terminated air flow through the channel 194. In alternate embodiments, any suitable system for reduced quantity idle air flow could be provided.

Figure 8B:
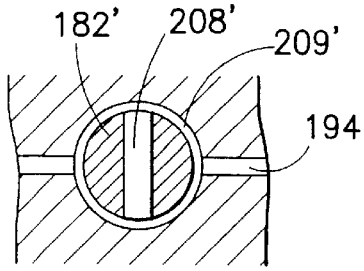
FIG. 8B is a cross-sectional view of an alternate embodiment of the present invention.

Fuel is delivered from the fuel metering chamber 184 to the idle pocket 198 through check valve 189, channels 200, 201 and low speed fuel needle valve 192. With the throttle shaft 182 at the idle position hole 208 is not aligned with the channel 194, as in FIG. 8B, and hole 210 is not aligned in the channel 196. Thus, at idle, fuel is pulled from idle pocket 198 through holes 206 into the idle main air channel (not shown) into the crankcase. When the throttle shaft 182 is rotated to the WOT position, hole 208' is aligned with channel 194 to create a larger vacuum pull of fuel into channel 194 from channel 203. In addition, hole 210 is aligned with channel 196 at WOT to allow air to flow into the idle pocket 198 wherein less fuel will be vacuum pulled out the holes 206; being substituted by air coming into the pocket 198 from channel 196. Thus, pocket 198 delivers less fuel at WOT to the crankcase then at idle.

Referring now to FIGS. 9A, 9B, 10A and 10B, the two carburetors 19, 20 of FIG. 1A are schematically shown as a single carburetor unit 300. The carburetor unit 300 has a frame 302, a choke shaft assembly 304 and a throttle shaft assembly 306. The frame 302 has a main channel 308 and a secondary channel 310. The main channel 308 is connected to the inlet 24. The secondary channel 310 is connected to the inlet 20. The choke shaft assembly 304 comprises a shaft 312 and a choke plate 314. The shaft 312 is rotatably mounted to the frame 302. The shaft 312 has a through hole 316 in one end located in the secondary channel 310. The choke plate 314 is located in the main channel 308. The throttle shaft assembly 306 generally comprises a shaft 318 and a throttle plate 320. The throttle shaft 318 has a through hole 322 in one end located in the secondary channel 310. The throttle plate 320 is located in the main channel 308. The shaft 318 is also rotatably mounted to the frame 302. The carburetor 300 preferably has linkages (not shown) located externally relative to the frame 302 and connected to the shafts 312, 318 for controlling rotation of the shafts.

Figure 9A:
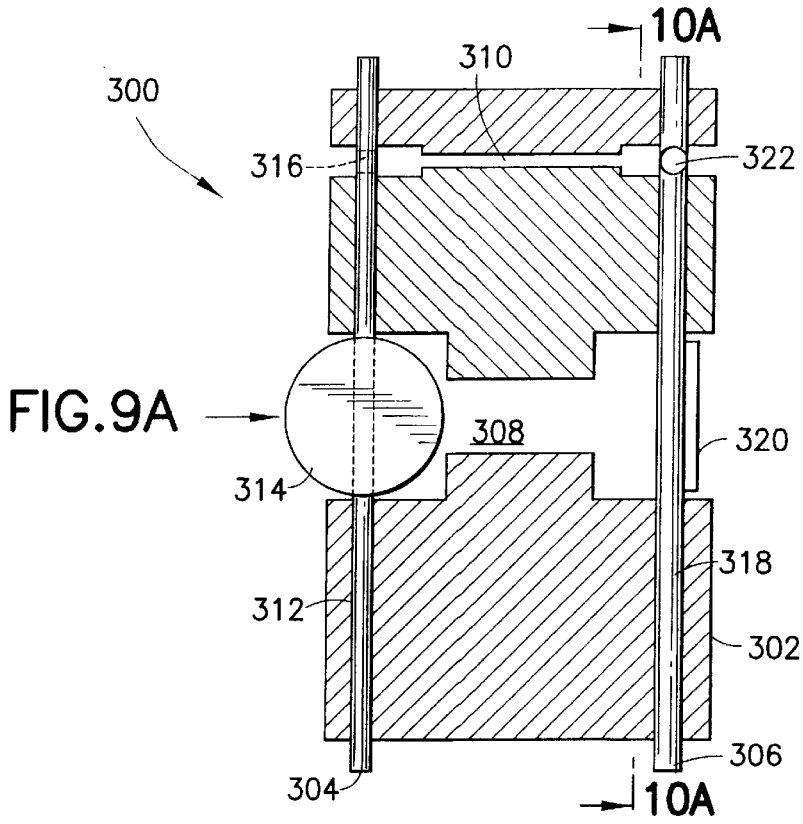
FIG. 9A is a schematic cross-sectional view of the fuel delivery component shown in FIG. 1A.

FIG. 9A shows the choke shaft assembly 304 in a non-choke position and the throttle shaft assembly 306 in an idle position. In the non-choke position the hole 316 is aligned with the secondary channel 310 to allow air to pass through the hole 316 into the channel 310. Also in the non-choke position the choke plate 314 is aligned generally parallel to the main channel 308 to allow air to flow above and below the choke plate into the main channel 308. The choke shaft assembly 304 can be rotated about 75° to rotate the hole 316 at least partially out of alignment with the channel 310 and move the choke plate 314 into a choke position to substantially reduce air flow into the main channel 308.

Figure 9B:
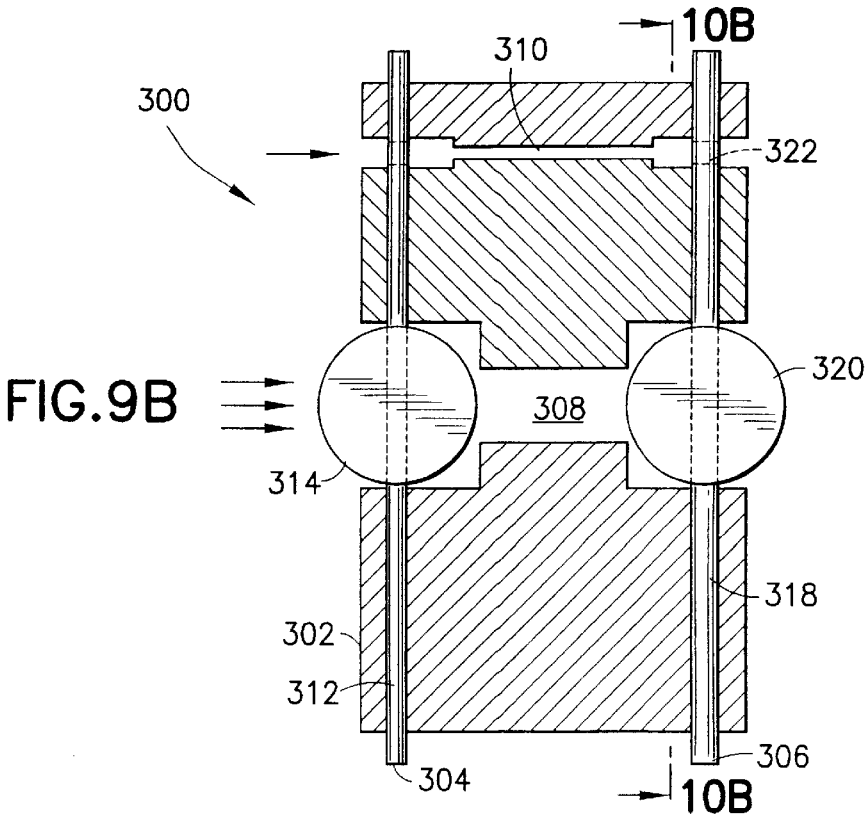
FIG. 9B is a schematic cross-sectional view of the component shown in FIG. 9A with the throttle shaft at a wide open throttle position.
Figure 10A:
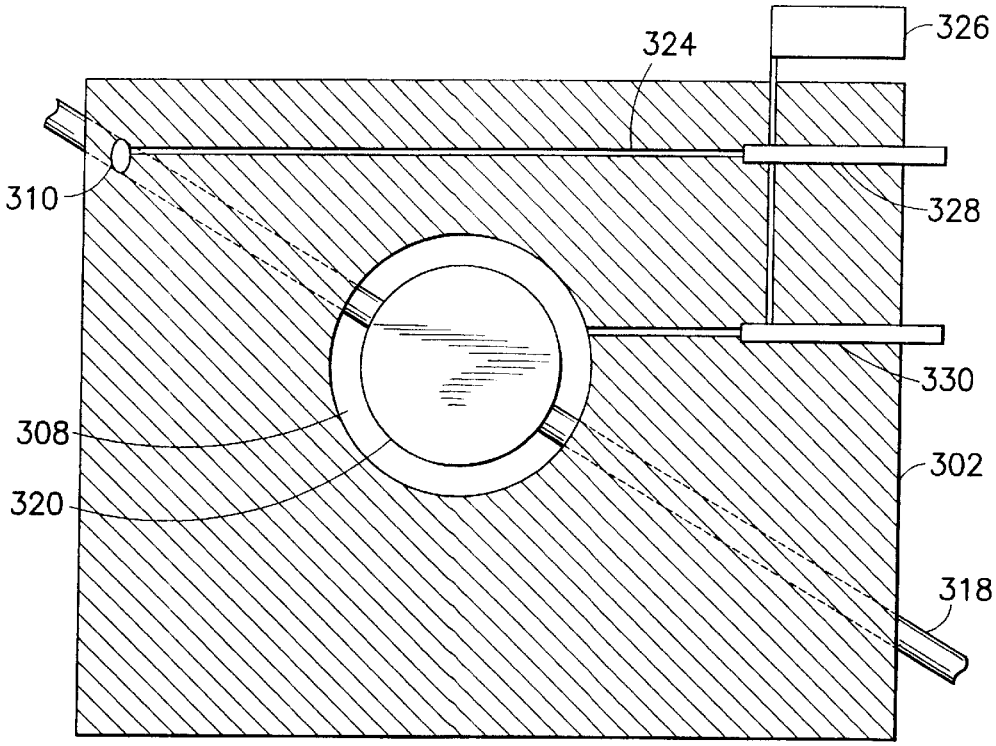
FIG. 10A is a schematic cross-sectional view of the component shown in FIG. 9A taken along line 10A—10A.
Figure 10B:
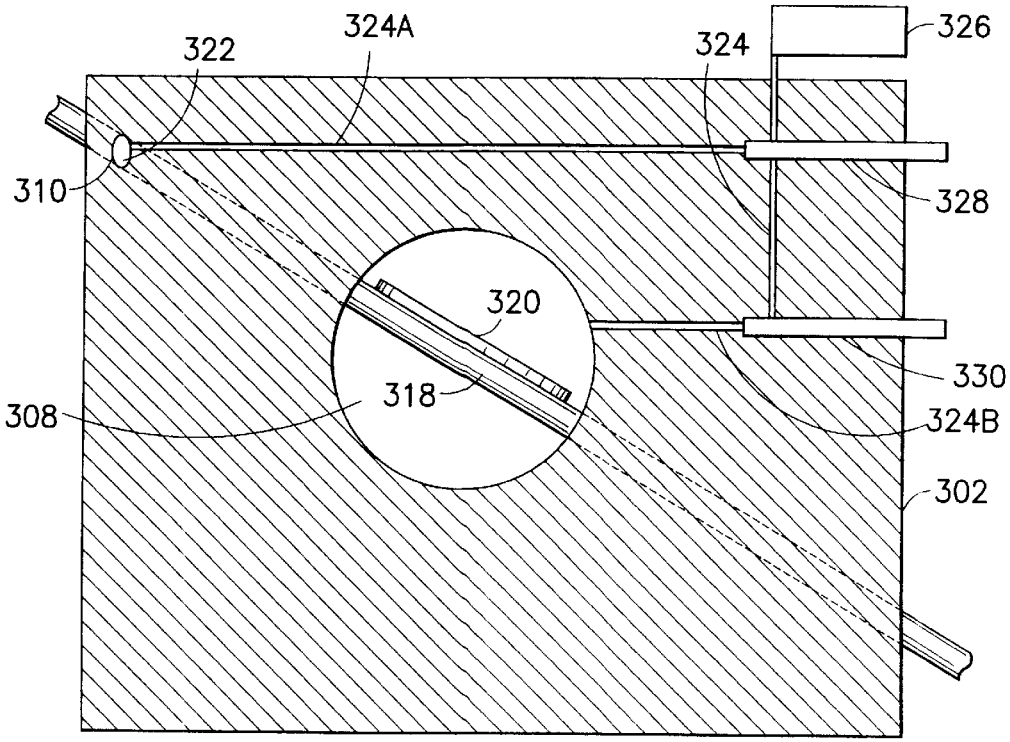
FIG. 10B is a schematic cross-sectional view of the component shown in FIG. 9B taken along line 10B—10B.

Referring also to FIG. 10A, FIGS. 9A and 10A show the throttle shaft assembly 306 in its idle position. In the idle position the throttle plate 320 substantially blocks or limits the passage of air through the main channel 308. Also in the idle position, the hole 322 is not aligned with the secondary channel 310. Thus, passage of air through the channel 310 is prevented or substantially prevented. Referring also to FIGS. 9B and 10B, the throttle shaft assembly 306 is shown rotated about 75° to a wide open throttle (WOT) position. The throttle plate 310 has been moved to a position generally parallel to the axis of the main channel 308 such that the main channel 308 is substantially open to allow air to relatively freely pass therethrough. The hole 322 is aligned with the secondary channel 310 to allow air to pass therethrough.

As seen in FIGS. 10A and 10B, the carburetor 300 also has a conduit system 324 to deliver fuel from a fuel metering device 326 to the channels 308, 310. Preferably, the fuel metering device is a diaphragm driven device. However, any suitable type of metering device could be used. The carburetor 300 has a high speed fuel flow control needle 328 and an idle speed fuel flow control needle 330 to adjust the quantity and rate of fuel flow from the metering device 326, through the conduit system 324, into the channels 308, 310. However, any suitable system for delivering fuel into the channels 308, 310 could be provided.

With the throttle shaft assembly 306 in the idle position shown in FIGS. 9A and 10A, the hole 322 is not aligned with the channel 310. Therefore, no fuel is delivered to the combustion chamber from the channel 310 and line 20 (see FIG. 1). In the idle position fuel is only delivered by the main channel 308, via the inlet 24, crankcase 18 and channel 42, to the combustion chamber. When the shaft 318 is rotated to the wide open throttle (WOT) position shown in FIGS. 9B and 10B, fuel is delivered to the accumulator 34 by the channel 310 and line 20. In particular, when the shaft 318 is moved to the position shown in FIGS. 9B and 10B, fuel is vacuum pulled from the line 324A of the conduit system 324, into the secondary channel 310, through the hole 322, through the inlet line 20 and into the accumulator 34. Because plate 320 is at an open position, the line 324B is exposed to significantly less vacuum pull. Thus, significantly less fuel is delivered to the main air passage 308 at the wide open throttle position. Almost all the fuel is delivered to the secondary channel 310.

Thus, the present invention switches fuel delivery, at least partially, between the main channel 308 at idle and the secondary channel 310 at wide open throttle. At wide open throttle a small amount of fuel/air will pass through the main air passage 308 to lubricate the components in the crankcase 18. During wide open throttle the vacuum in line 324A starves the line 324B of most fuel. A smooth transition is provided as the fuel delivery system switches between idle and wide open throttle conditions. During wide open throttle almost pure air is entering inlet 24 into the crankcase 18. The engine 10 could have an additional or alternative lubrication system.

As is known in the art for small two stroke engines, misfires (i.e.: no combustion in the combustion chamber) can occur as much as one-third of the time. If a misfire occurs in the engine 10 a compression wave will not pass into the accumulator 34. One of the features of the present invention is that the inlet aperture 30 is sized to prevent the accumulator 34 from totally discharging into the cylinder 12. In other words, the accumulator 34 can be pressurized for the entire time that the inlet 30 is open such that compressed air is continually exerting pressure out the inlet 30 when the inlet 30 is open. This occurs regardless of whether there has been combustion or a misfire. Since the piston head 40 opens and closes all of the ports/channels 24, 28, 30, 38, 42, the engine 10 can be designed to provide different performance characteristics by changing the positions of the ports/channels 24, 28, 30, 38, 42 relative along the length of the cylinder and/or relative to each other along the length of the cylinder. This can change the timing of how long the accumulator is charged with compressed air from the crankcase, how long the accumulator blows off, how long the accumulator injects into the cylinder, etc. This can also change pressure rate changes, such as if the transfer channel, exhaust outlet or air inlet open sooner or later in the piston cycle. The two shaft assemblies 180, 182 or 304, 306 or 412, 414 (described below) could include selectively interacting links, such as disclosed in U.S. patent application Ser. No. 09/417,562, filed Oct. 14, 1999 which is hereby incorporated by reference in its entirety.

Figure 11:
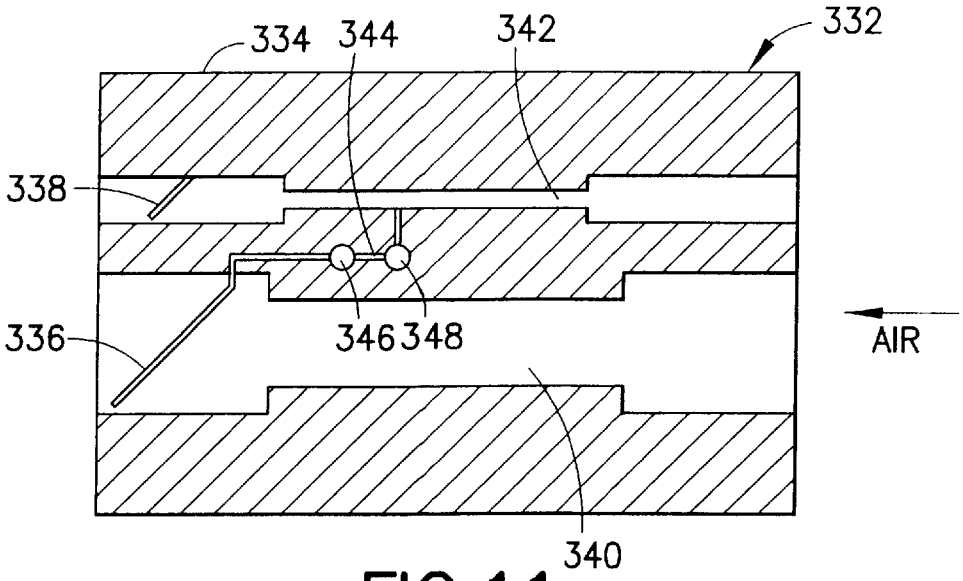
FIG. 11 is a schematic cross-sectional view of an alternate embodiment of the present invention.

Referring now to FIG. 11, a schematic cross-sectional view of an alternate embodiment is shown. In this embodiment the carburetor 332 has a frame 334, a main throttle plate 336 and an auxiliary throttle plate 338. The carburetor preferably has a separate choke assembly (not shown). The frame 334 has a main channel 340, an auxiliary channel 342 and a fuel conduit system 344. The carburetor 332 also has an idle fuel flow needle 346 and a high speed fuel flow needle 348 connected to the fuel conduit system 344.

Figure 12:
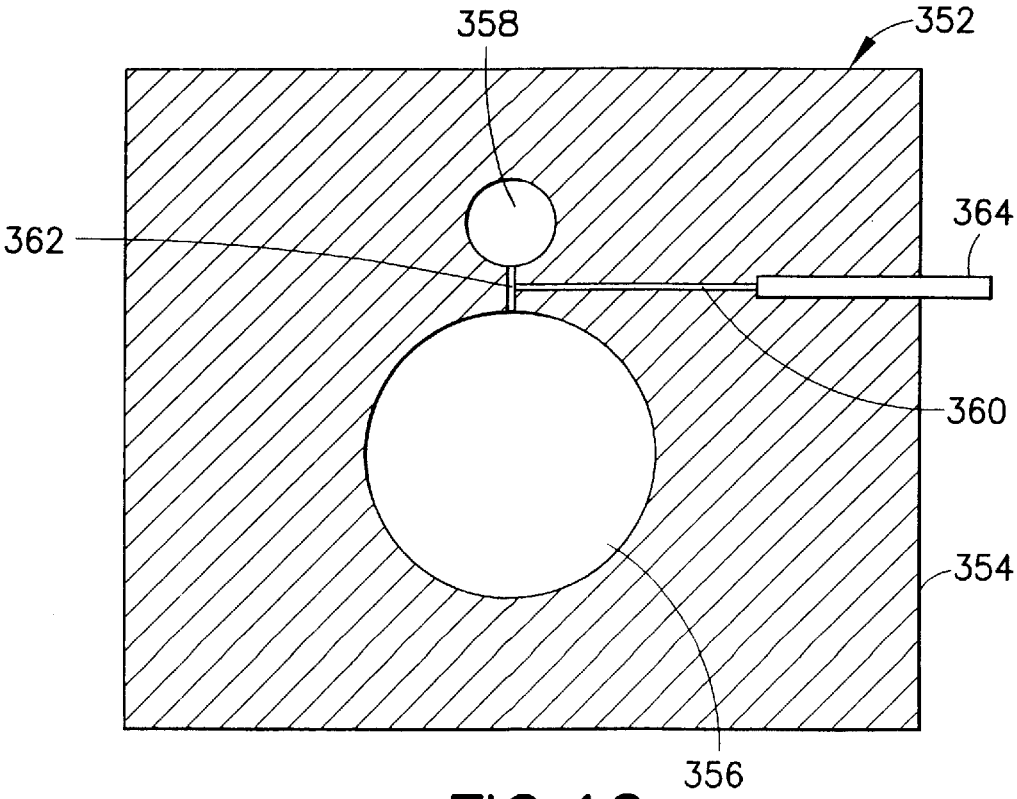
FIG. 12 is a schematic cross-sectional view of another alternate embodiment of the present invention.

Referring now to FIG. 12, a schematic cross-sectional view of another alternate embodiment is shown. The carburetor 352 has a frame 354 with a main channel 356, an auxiliary channel 358, and a fuel conduit system 360. The fuel conduit system has a "T" shaped branch section 362 that terminates its opposite ends in the two channels 356, 358. A single fuel flow adjustment needle 364 is connected to the bottom of the branch section 362. Once the fuel enters the branch section 362 delivery of the fuel to the channels 356, 358 is controlled by differential vacuum pressures in the two channels.

The present invention helps to eliminate the need for an additional component to act as an auxiliary carburetor. The auxiliary venturi is built into the standard cube existing carburetor frame. The air intake passages are drilled through the throttle and choke shafts so that fuel flow is controlled by the same throttle as well as means for choking the auxiliary carburetor section for starting the engine. The system can also be built by having internal venturi through the center area above the throttle body. The intake to the secondary venturi will be routed through the carburetor casting frame and through the choke and throttle shafts. A venturi is drilled into the body at the carburetor through the choke and the throttle shafts. Fuel is taken from the existing regulator after the fuel passes through the high speed needle or any adjustment needle in the case of the single needle design. This should operate in the same manner as the original design having two separate carburetors without the complexity of having an additional block for the second carburetor frame. The present invention provides a cost reduction by incorporating the auxiliary carburetor section into the main carburetor. The present invention also provides a choking mechanism in the secondary carburetor section for easier starting of the engine.

Figure 13:
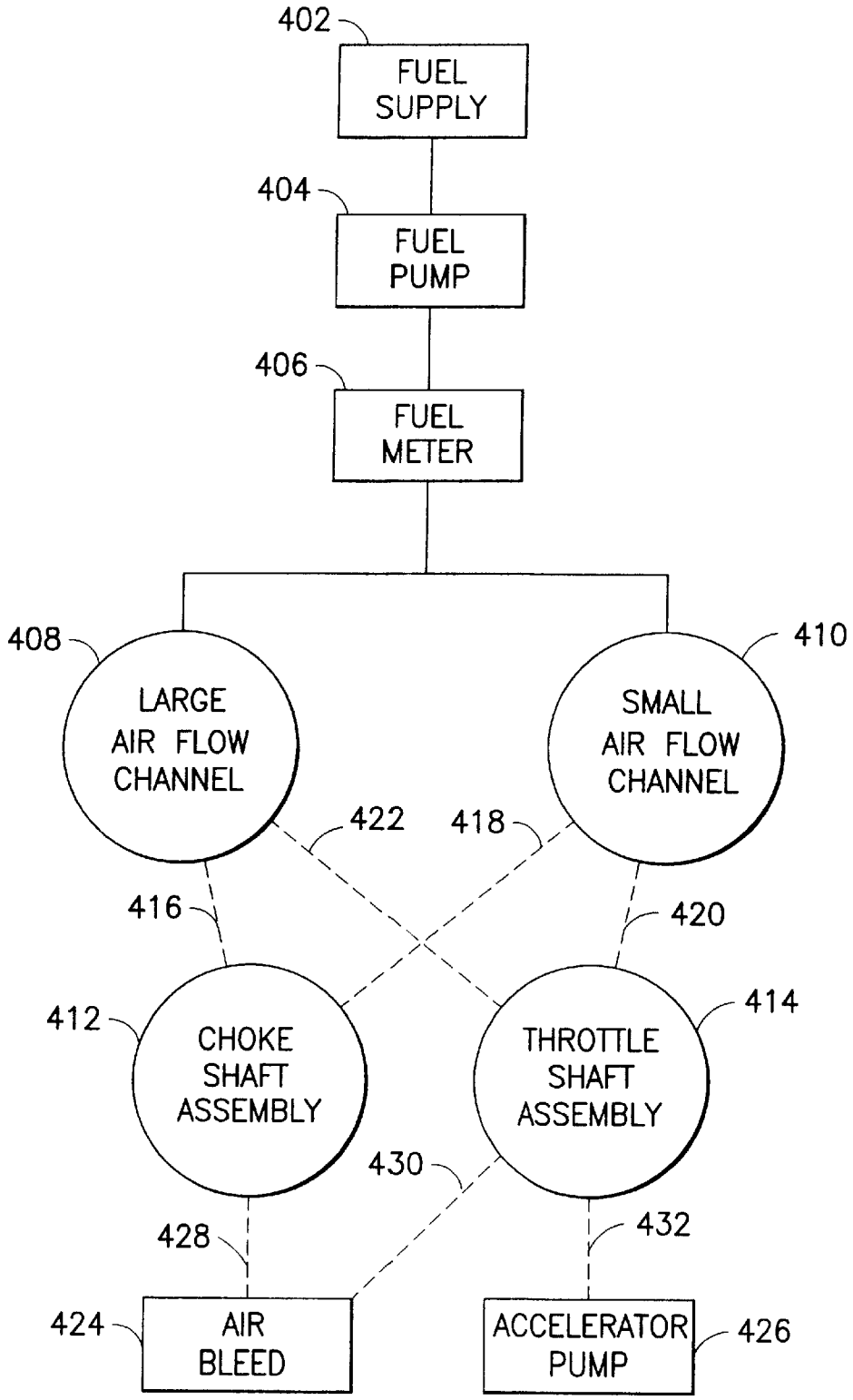
FIG. 13 is a schematic illustration of an embodiment of the present invention.

Referring now to FIG. 13 another alternate embodiment will be schematically described. In this embodiment the carburetor unit has a fuel pump 404 which is connected to a fuel supply 402, such as a gasoline tank. The fuel pump is connected to the two air flow channels 408, 410 by a fuel meter 406. The first air flow channel 408 is a relatively large air flow channel relative to the second small air flow channel 410. Flow of air through the two channels 408, 410 is controlled, at least partially, by two shaft assemblies; choke shaft assembly 412 and throttle shaft assembly 414. As illustrated by dashed control lines 416, 418, the choke shaft assembly 412 is adapted to at least partially control flow through the two channels 408, 410. Likewise, as illustrated by dashed control lines 420, 422, the throttle shaft assembly 414 is adapted to at least partially control flow through the two channels 408, 410. In this embodiment the carburetor unit also includes an air bleed channel or circuit 424 and an accelerator pump 426. The air bleed channel 424 is used as part of the bypass idle circuit. The accelerator pump 426 is used to pump a charge of fuel from the carburetor unit when the carburetor is moved from an idle position to the wide open throttle position. In this embodiment the air bleed channel 424 is controlled, at least partially, by the two control shaft assemblies 412, 414 as illustrated by dashed control lines 428, 430. In an alternate embodiment, the air bleed channel 424 could be controlled by only one of the shaft assemblies. Also in an alternate embodiment, the air bleed circuit 424 could be fixed rather than variable. As illustrated by control line 432, the throttle shaft assembly 414 at least partially controls the accelerator pump 426. In an alternate embodiment the accelerator pump need not be provided. Alternatively, the accelerator pump could be controlled by some other type of control. In the embodiment shown, the throttle shaft assembly 414 is adapted to control at least four functions; flows through channels 408, 410, 424 and a channel of the accelerator pump 426. Similarly, the choke shaft assembly 412 is adapted to control at least three functions; flows through the three channels 408, 410 and 424. The two control shaft assemblies can also be selectively interconnected as described in U.S. patent application Ser. No. 09/417,562.

Figure 14:
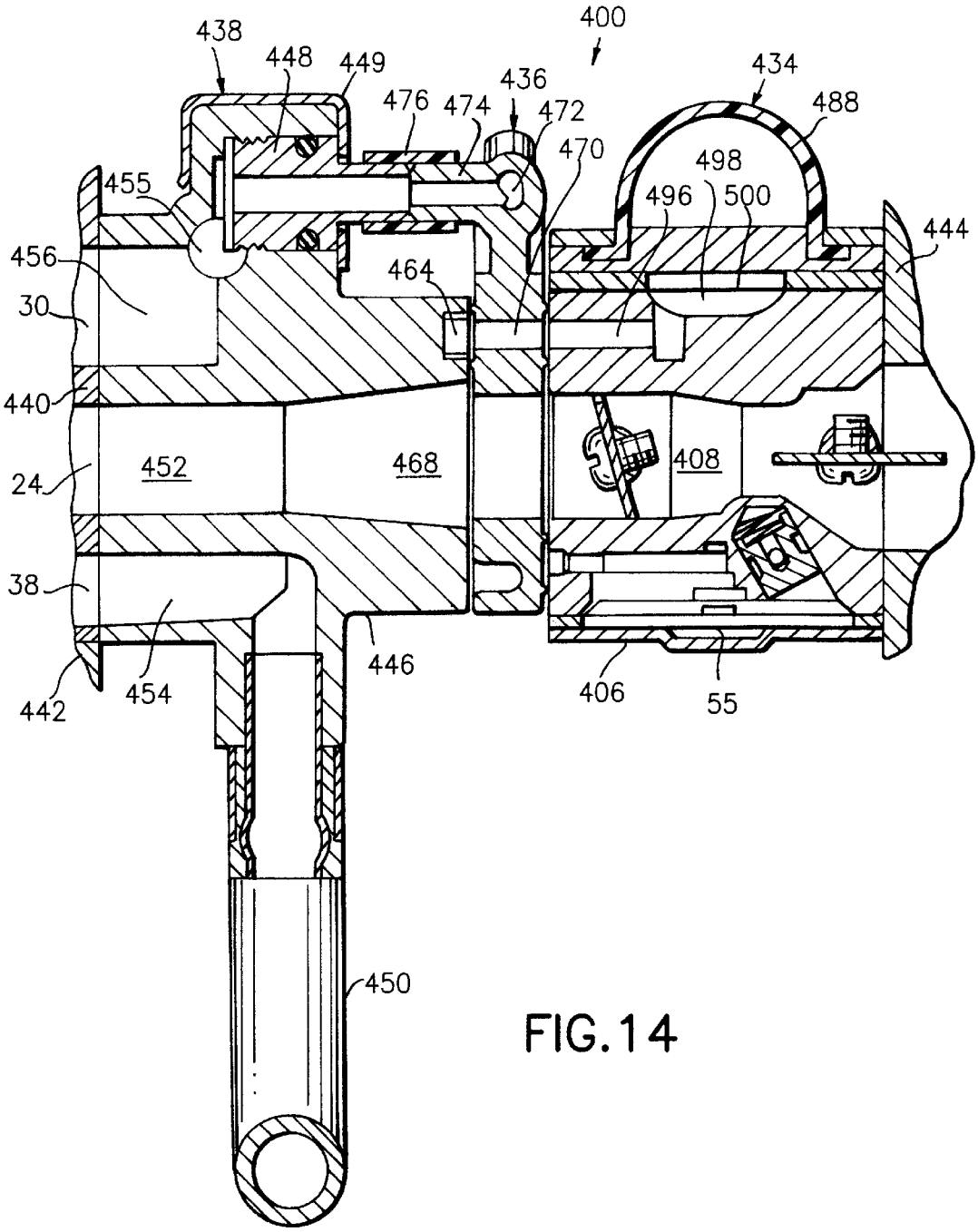
FIG. 14 is a schematic cross-sectional view of the embodiment shown in FIG. 13.

Referring also to FIG. 14, a schematic cross-sectional view of a portion of an engine 400 incorporating the system shown in FIG. 13 is shown. In this embodiment the carburetor unit 434 includes a carburetor adapter plate 436 and a combined heat dam and accumulator assembly 438 which connects the carburetor unit 434 to the cylinder 440 and crankcase 442 of the engine. An air filter 444 is connected to an outward side of the carburetor unit 434.

Figure 15:
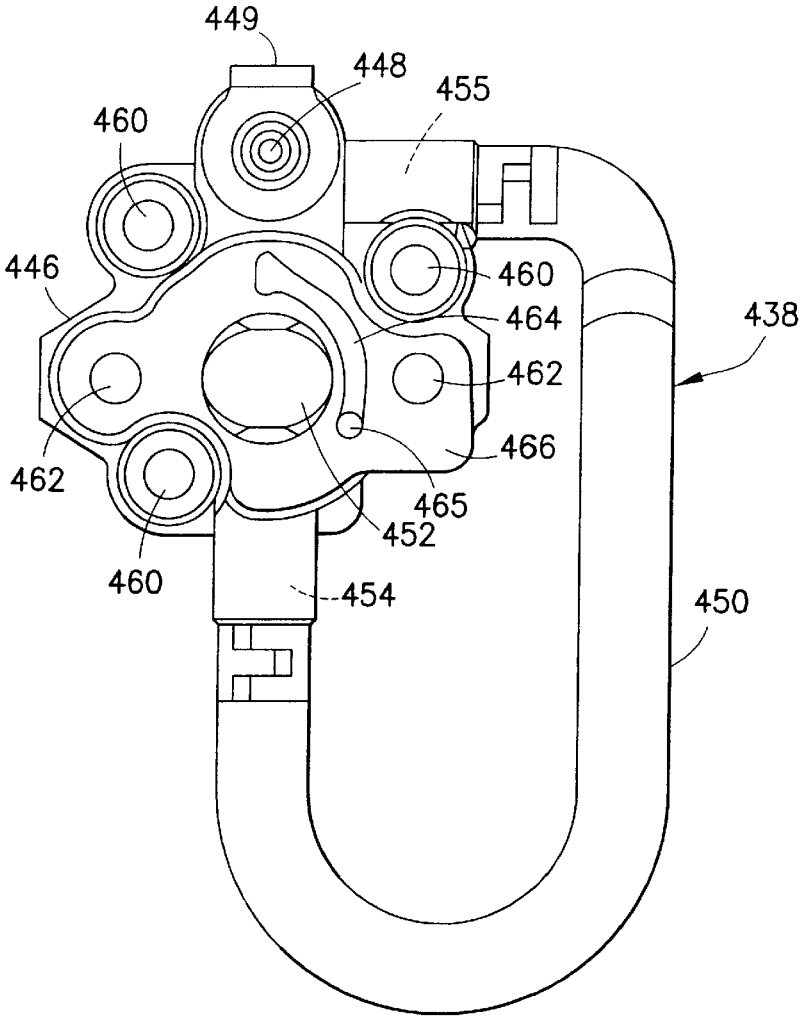
FIG. 15 is an elevational view of an outward side of the combined heat dam and accumulator assembly shown in FIG. 14.

Referring also to FIG. 15, the combined heat dam and accumulator assembly 438 generally comprises a frame 446, a check valve 448, and an accumulator tube 450. The frame 446 comprises a main air inlet channel 452, two conduit sections 454, 455 and an inlet 456. The main air inlet channel 452 is connected to the inlet 24. The bottom conduit section 454 is connected to the port 38. The top conduit section 455 is connected to the inlet 456 which is connected to the port 30 into the combustion chamber of the cylinder 440. The tube 450 connects the two conduit sections 454, 455 to each other. The check valve 448 has an exit into the top conduit section 455. A clip 449 retains the check valve 448 on the frame 446. The port 30 is piston ported. Thus, the check valve 448 allows fuel and air to be sucked into the accumulator channel 454, 450 by suction from the crankcase applied at port 38, but substantially prevents hot combustion gases from the cylinder from passing through the check valve 48, and also substantially prevents the fuel/air charge in the accumulator from re-entering back into the check valve 448 when pushed out of the accumulator by air from the crankcase entering through the port 38. The frame 446 also includes three mounting holes 460 for use with fasteners (not shown) to attach the assembly 438 to the cylinder 440, two pass-through mounting holes 462 and a channel 464 on an outward side 466 which the adapter 436 is located against. The channel 464 communicates with crankcase pressure through hole 465.

Figure 16:
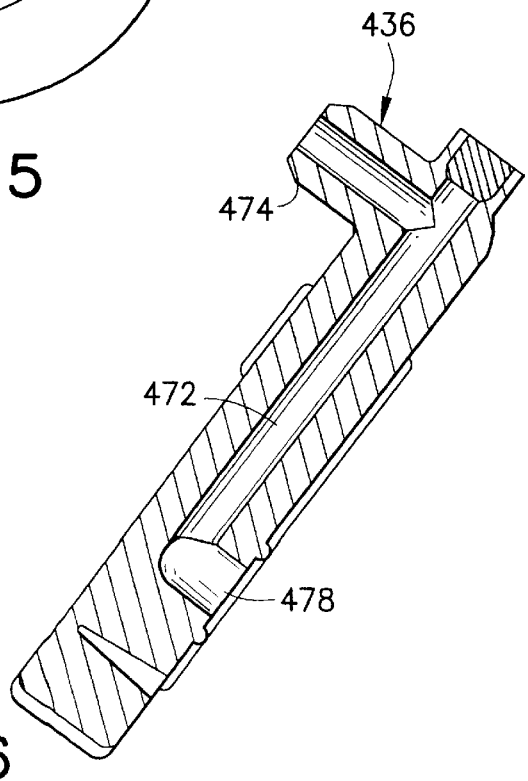
FIG. 16 is a cross-sectional view of the adapter shown in FIG. 14.

Referring also to FIG. 16, the adapter 436 includes two pass-through mounting holes (not shown) similar to holes 462, a pass-through flow holes 468 (see FIG. 14), a pressure pass-through hole 470 (see FIG. 14), and a channel 472 which extends into a post 474. The main flow channels 468 is aligned with the main channel 452 of the combined heat dam and accumulator assembly 438. The pressure pass-through hole 470 is aligned with the top of the channel 464 on the outward side 466 of the assembly 438. The channel 472 is connected to the check valve 448 at one end by the post 474 and a small piece of tube 476. The entrance 478 into the channel 472 is aligned with the small air flow channel 410 (see FIGS. 13 and 17A) as further understood below. The main flow channel 468 is also aligned with the main air flow channel 408.

Figure 17A:
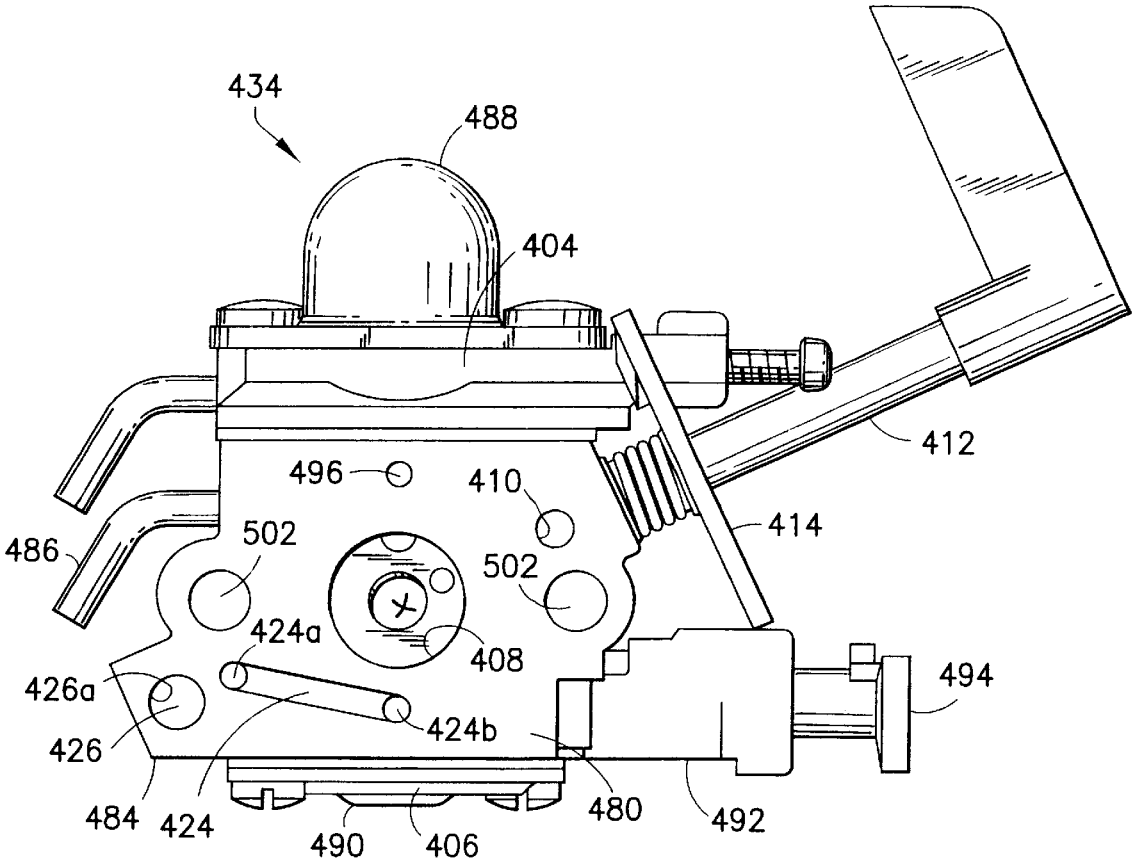
FIG. 17A is an elevational view of an inward side of the carburetor unit shown in FIG. 14.
Figure 17B:
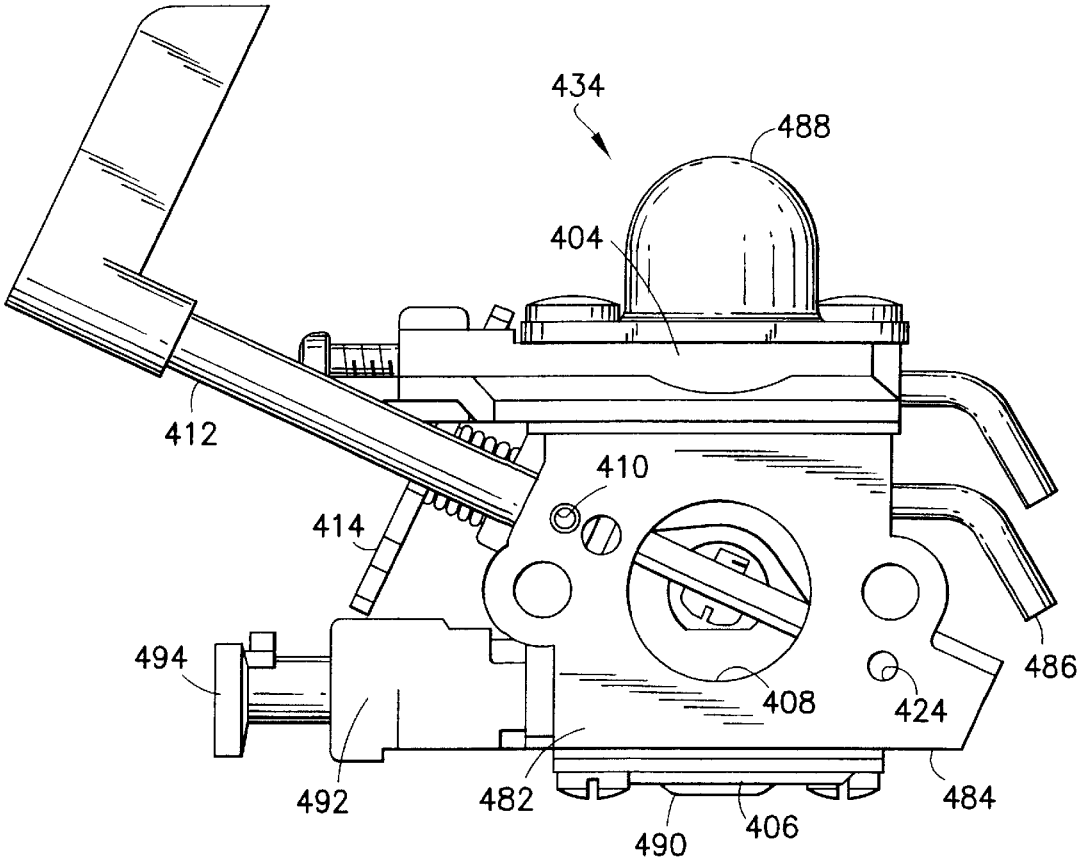
FIG. 17B is an elevational view of an outward side of the carburetor unit shown in FIG. 14.

Referring also to FIGS. 17A and 17B, inward facing and outward facing elevational side views of the carburetor unit 434 are shown, respectively. The inward facing side 480 is located against the outward facing side of the adapter 436. The outward facing side 482 has the air filter 444 located against it. The two air flow channels 408, 410 extend between the two sides 480, 482 and each preferably has a venturi therein. The fuel pump 404 is located at the top of the frame 484. The fuel inlet connector 486 connects a fuel line (not shown) from the gasoline tank (not shown) to the fuel pump 404. The fuel pump is preferably a diaphragm driven pump which is driven by crankcase pressures. However, any suitable fuel pump could be provided. An internal conduit (not shown) through the frame 484 supplies fuel from the pump 404 to the fuel meter 406. The fuel meter 406 is connected to the bottom of the frame 484.

Figure 17C:
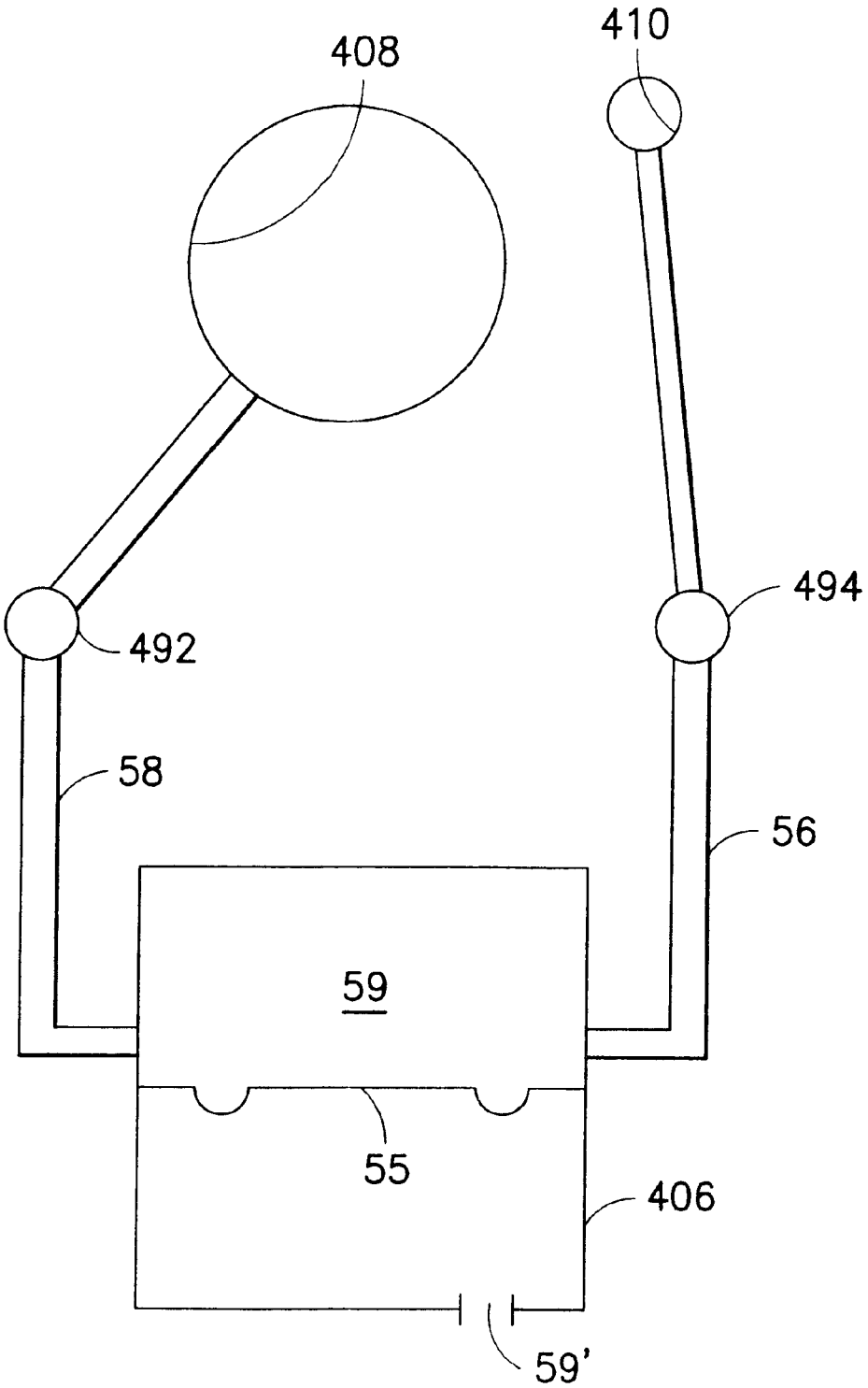
FIG. 17C is a schematic diagram of the fuel supply system in the carburetor unit shown in FIG. 17A between the fuel meter and the two air flow channels.

As schematically illustrated by FIG. 17C, the two conduits 56, 58 through the frame 484 extend from the same fuel chamber 59 of the fuel meter 406. The carburetor unit 434 includes two fuel mixture needle screws 492, 494 connected to the frame 484 (see FIG. 17A) and intersecting the conduits 56, 58. The conduits 56, 58 extend past the needle screws 492, 494 to the air flow channels 408, 410.

In addition to the flow holes 408, 410, the frame 484 includes a channel 496 (see FIGS. 14 and 17A) from the inward side 480 into the chamber 498 of the pump 404. Channels 496, 470, 464 and 465 connect the chamber 498 to crankcase pressure in the crankcase 442 to drive the diaphragm 500 of the pump 404. Mounting holes 502 (see FIG. 17A) are aligned with holes 462 in the assembly 438 and through-holes (not shown) in the adapter 436 to allow fasteners (not shown) to attach the three components 434, 436, 438 to the cylinder 440.

Figure 18A:
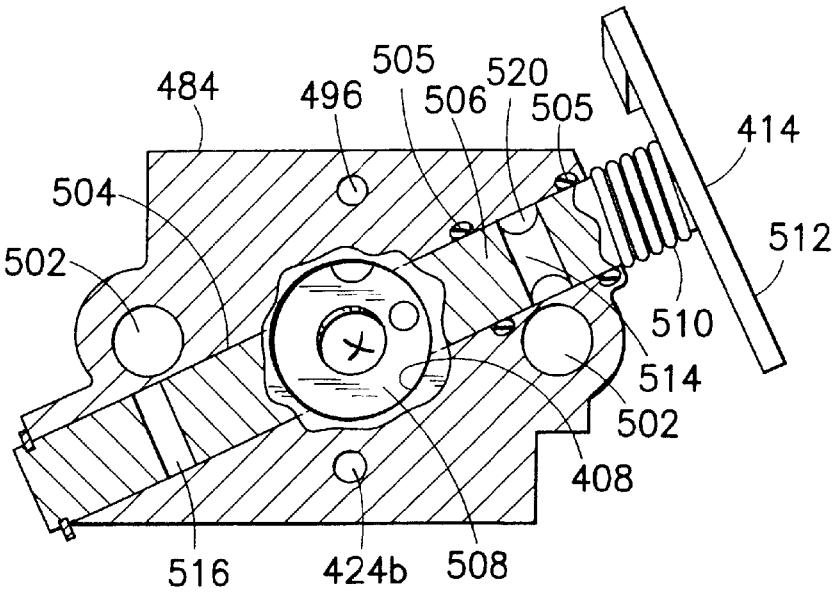
FIG. 18A is a partial cross-sectional view of the frame and the throttle shaft assembly shown in FIG. 17A at an idle position.
Figure 18B:
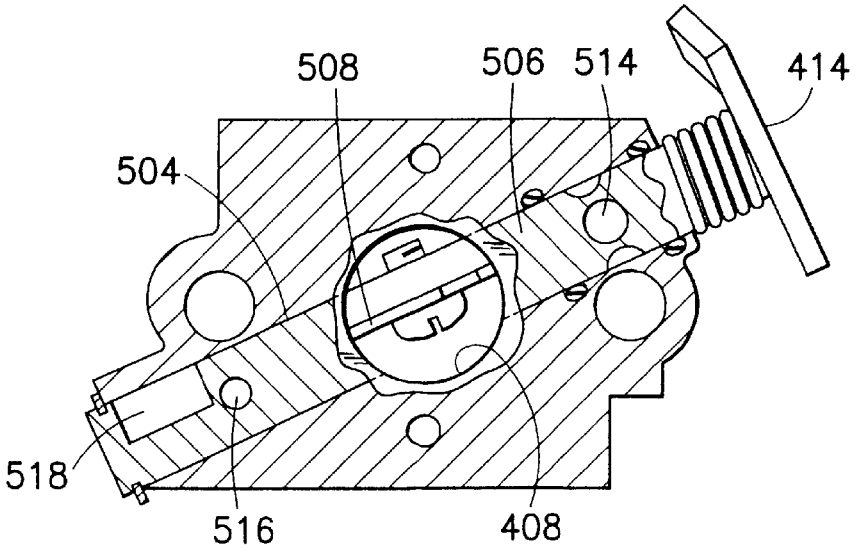
FIG. 18B is a partial cross-sectional view as in FIG. 18A with the throttle shaft assembly at a wide open throttle position.

Referring also to FIGS. 18A and 18B, the frame 484 has a throttle shaft hole 504. The throttle shaft hole 504 extends through the two air flow channels 408, 410 and also through a portion 424*a* of the air bleed channel 424 and a portion of the channel 426*a* that forms the accelerator pump 426 (see FIG. 17A). The throttle shaft assembly 414 generally comprises a shaft 506, a throttle plate 508, a spring 510 and a control lever 512. The control lever 512 is preferably connected by a control cable to a user actuated throttle trigger (not shown) The spring 510 biases the throttle shaft assembly at an idle position. The throttle plate 508 is fixedly attached to the shaft 506 and located in the main air channel 408. The throttle shaft 506 includes two through-holes 514, 516 and a cut-out section 518 (see FIG. 18B). In a preferred embodiment the shaft 506 also has an annular groove 520 at the first through-hole 514. In a preferred embodiment O-ring seals 505 are provided between the frame 484 and the shaft 506 on opposite sides of the groove 520. FIG. 18A shows the throttle shaft assembly 414 at an idle position. In the idle position the shaft 506 blocks the accelerator pump channel 426*a* and the portion 424*a* of the air bleed channel 424 and substantially blocks the small air flow channel 410 (allowing a small amount of air and fuel to pass through groove 520). The plate 508 partially restricts air and fuel from passing through the channel 408. FIG. 18B illustrates when the throttle shaft assembly 414 has been moved to the wide open throttle position. The first through-hole 514 is now aligned with the channel 410 to allow a greater amount of air and fuel to be sucked into the accumulator through the check valve 448 (see FIG. 14). The second through-hole 516 is aligned with the portion 424*a* of the air bleed channel 424. The cut-out section 518 opens a path out of the accelerator pump channel 426*a* as well as the shaft 506 actuating the accelerator pump. The throttle plate 508 is moved to an open position to allow more air to pass through the channel 408 and which also reduces the suction force on the conduit 58 thereby having less fuel enter the channel 408 at wide open throttle than at idle. The fuel entering the channel 408 at wide open throttle is primarily used for lubrication of comets in the crankcase and not for combustion. Thus, the channel 408 is not substantially used as a carburetor during wide open throttle, but primarily as an air inlet and lubricant supply conduit. Throttle shaft assembly 414 can be used with the channel 408 at wide open throttle primarily as an air throttle; not a fuel/air throttle. This could also be true at idle if almost all the fuel is delivered by the accumulator and air channel 410 at idle. However, if the fuel for combustion at idle is delivered by the larger channel 408, it is preferred to allow at least some air and fuel to pass through the smaller channel 410 at idle in order to keep the smaller fuel supply system to the accumulator in a wet condition or state.

Figure 19A:
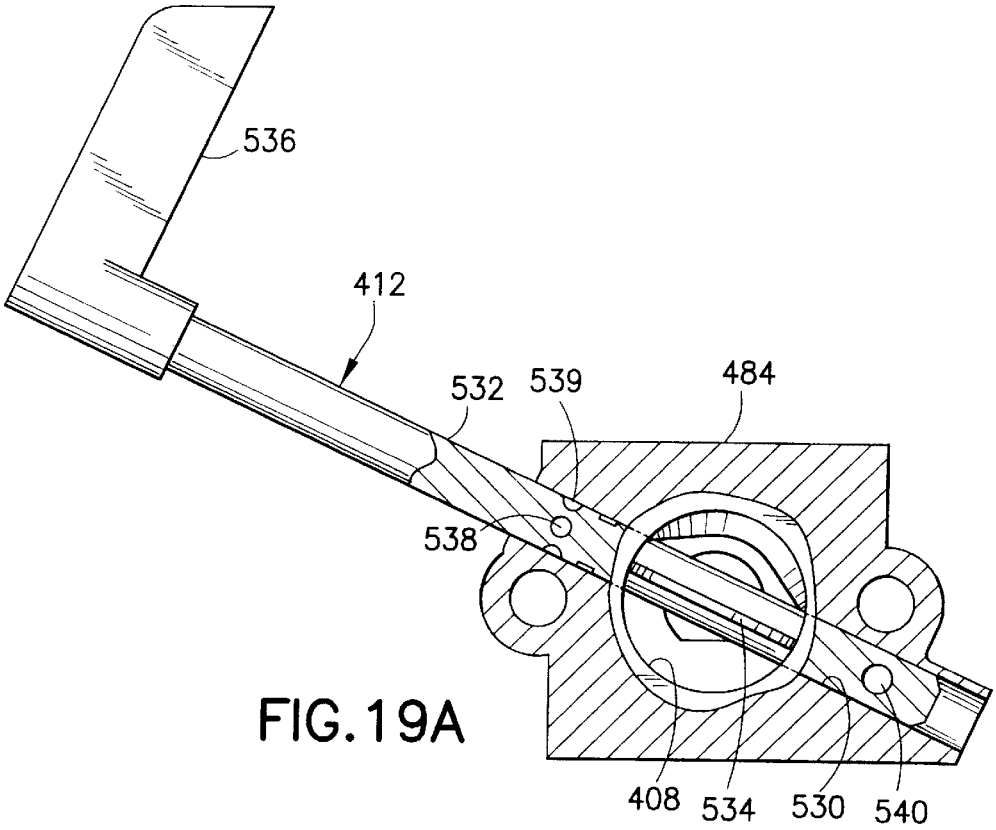
FIG. 19A is a partial cross-sectional view of the frame and the choke shaft assembly shown in FIG. 17B at a nonchoke position.
Figure 19B:
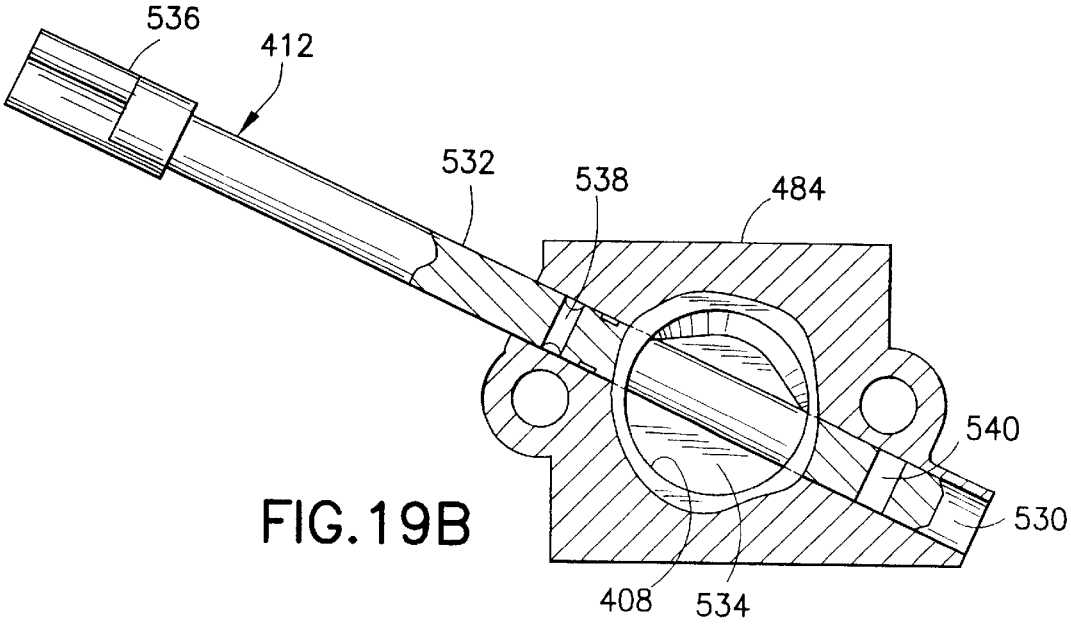
FIG. 19B is a partial cross-sectional view as in FIG. 19A with the choke shaft assembly at a choke position.

Referring now also to FIGS. 19A and 19B, the frame 484 includes a choke shaft hole 530. The hole 530 passes through the two channels 408, 410 and the portion 424*a* of the air bleed channel 424. The choke shaft assembly 412 generally comprises a shaft 532, a choke plate 534, and a user actuated control lever or handle 536. The choke plate 534 is located in the main channel 408. The shaft assembly 412 is rotatable about 75° between the choke position shown in FIG. 19B and the non-choke position shown in FIG. 19A. The choke shaft 532 has the choke plate 534 fixedly attached to it and also comprises two through-holes 538 and 540. As the choke shaft 532 is rotated between its choke and non-choke positions, the first hole 538 is misaligned with and aligned with the smaller channel 410, respectively. Likewise, as the choke shaft 532 is rotated between its choke and non-choke positions, the second hole 540 is misaligned with and aligned with the portion 424*a* of the air bleed channel 424. Thus, the choke shaft assembly 412 can open and block the air bleed channel 424 as well as choke the two air channels 408, 410. Similar to the shaft 506, the shaft 532 preferably has an annular groove 539 around the shaft 532 at the hole 538 such that a small amount of air can pass through the groove 539 when the choke shaft assembly is in a choke position.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetors that switch delivery of fuel to two different locations based upon the speed of the engine, and uses an accumulator with piston ported reflected compression wave delivery of scavenged compressed air to deliver fuel at a wide open throttle position.

2. A carburetor system for use with an internal combustion engine, the carburetor system comprising:

a frame forming two air conduits;

a fuel metering device connected to the frame for delivering fuel to the two air conduits; and a fuel delivery varying system for varying amounts of fuel delivered from the fuel metering device to the two air conduits when speed of the engine or load on the engine changes, wherein the fuel delivery varying system is adapted to increase fuel delivery to a first one of the air channels with a substantially simultaneous decrease in fuel delivery to a second one of the air channels.

3. A carburetor system as in claim 2 wherein a cross-sectional flow path area of the first air channel is substantially larger than a cross-sectional flow path area of the second air channel.

4. A carburetor system as in claim 2 further comprising a fuel pump connected to a fuel chamber of the fuel metering device.

5. A carburetor system as in claim 4 wherein the fuel chamber communicates with both the first and second air channels such that the fuel chamber is a common fuel chamber for both the first and second air channels.

6. A carburetor system as in claim 2 wherein the fuel delivery varying system comprises a system for suction pulling fuel from the fuel metering device into the second air channel based upon suction in a crankcase of the engine, and a system for reducing suction force applied by the suction force, applied by the suction in the crankcase, to the fuel metering device.

7. A carburetor system as in claim 6 wherein the system for reducing suction force comprises a rotatable shaft extending through the second air channel with a through hole that is aligned with and misaligned with the second air channel when the shaft is rotated.

8. A carburetor system as in claim 7 wherein the shaft is a throttle shaft having a throttle plate located in the first air channel and connected to the throttle shaft, wherein flow of air through the first air channel can be increased and flow of fuel through the first air channel can be decreased as flow of fuel through the through-hole in the throttle shaft is increased.

9. A carburetor system as in claim 2 wherein the fuel delivery varying system comprises a rotatable shaft with a through-hole through the shaft generally transverse to a longitudinal axis of the shaft.

10. A carburetor system as in claim 9 further comprising an air flow plate connected to the shaft, the plate being located in the first air channel.

11. A carburetor system as in claim 9 wherein the shaft further comprises a groove on an outside surface of the shaft proximate the through-hole.

12. A method of delivering fuel in a carburetor to an internal combustion engine, the method comprising steps of:

delivering liquid fuel from a fuel supply to a first air channel of the carburetor;

delivering liquid fuel from the fuel supply to a second air channel of the carburetor; and decreasing fuel delivery to the first air channel when fuel delivery is increased to the second air channel;

wherein fuel is delivered from the same fuel supply through the first and second air channels to two respective spaced locations for delivery to a same cylinder of the engine, and wherein a flow rate per piston cycle of fuel delivery to a first one of the spaced locations through the first air channel is decreased as a flow rate per piston cycle of fuel delivery to a second one of the spaced locations through the second air channel is increased.

13. A method of delivering fuel in a carburetor to an internal combustion engine, the method comprising steps of:

delivering fuel from a fuel supply to a first air channel of the carburetor;

delivering fuel from the fuel supply to a second air channel of the carburetor;

decreasing fuel delivery to the first air channel when fuel delivery is increased to the second air channel; and stopping substantially all fuel delivery to the first air channel when the engine is at a wide open throttle condition and fuel delivery to the second air channel is at a maximum rate per piston cycle, wherein fuel is delivered from the same fuel supply through the first and second air channels to two respective spaced locations for delivery to a same cylinder of the engine, and wherein a flow rate and piston cycle of fuel delivery to a first one of the spaced locations through the first air channel is decreased as a flow rate per piston cycle of fuel delivery to a second one of the spaced locations through the second air channel is increased.

14. A method of delivering fuel in a carburetor to an internal combustion engine, the method comprising steps of:

delivering fuel from a fuel supply to a first air channel of the carburetor;

delivering fuel from the fuel supply to a second air channel of the carburetor; decreasing fuel delivery to the first air channel when fuel delivery is increased to the second air channel; and stopping substantially all fuel delivery to the second air channel when the engine is at an idle condition and fuel delivery to the first air channel is at a maximum rate per piston cycle, wherein fuel is delivered from the same fuel supply through the first and second air channels to two respective spaced locations for delivery to a same cylinder of the engine, and wherein a flow rate and piston cycle of fuel delivery to a first one of the spaced locations through the first air channel is decreased as a flow rate per piston cycle of fuel delivery to a second one of the spaced locations through the second air channel is increased.

15. A method of delivering fuel in a carburetor to an internal combustion engine, the method comprising steps of:

delivering fuel to a first air channel of the carburetor;

delivering fuel to a second air channel of the carburetor; and decreasing fuel delivery to the first air channel when fuel delivery is increased to the second air channel;

wherein fuel is delivered through the first and second air channels to two respective spaced locations for delivery to a same cylinder of the engine, wherein a flow rate and piston cycle of fuel delivery to a first one of the spaced locations through the first air channel is decreased as a flow rate per piston cycle of fuel delivery to a second one of the spaced locations through the second air channel is increased, and wherein the step of delivering fuel to the second air channel comprises using suction from a crankcase of the engine to pull fuel into the second air channel.

16. A method as in claim 15 wherein the step of decreasing fuel delivery to the first air channel comprises increasing suction force pulling of fuel into the second air channel to at least partially starve the first air channel of fuel from a fuel metering system common to the first and second air channels.

17. A method of delivering fuel in a carburetor to an internal combustion engine, the method comprising steps of:

delivering fuel from a fuel supply to a first air channel of the carburetor;

delivering fuel from the fuel supply to a second air channel of the carburetor or; and decreasing fuel delivery to the first air channel when fuel delivery is increased to the second air channel;

wherein fuel is delivered from the same fuel supply through the first and second air channels to two respective spaced locations for delivery to a same cylinder of the engine, wherein a flow rate and piston cycle of fuel delivery to a first one of the spaced locations through the First air channel is decreased as a flow rate per piston cycle of fuel delivery to a second one of the spaced locations through the second air channel is increased, and wherein the step of decreasing fuel delivery to the first air channel when fuel delivery is increased to the second air channel comprises rotating a single shaft of a throttle shaft assembly to increase air flow through both the first and the second air channels.

18. A method of delivering fuel in a carburetor to a two-stroke internal combustion engine, the method comprising steps of:

delivering fuel to a fuel and air delivery channel in the carburetor; and varying an amount of fuel being delivered to the fuel and air delivery channel based, at least partially, upon suction generated by air being pulled through a main air channel of the carburetor into a crankcase of the engine, wherein substantially all the fuel in the fuel and air delivery channel is introduced into a combustion chamber of the engine without passing through the crankcase.

19. A method as in claim 18 wherein the step of delivering fuel to the fuel and air delivery channel comprises suction pulling fuel into the fuel and air delivery channel.

20. A method as in claim 19 wherein the step of varying further comprises increasing a cross-sectional flow area of a fuel flow path to the fuel and air delivery channel.

21. A method as in claim 18 wherein the step of varying comprises rotating a throttle shaft assembly of the carburetor to allow an increased air flow through both the fuel and air delivery channel and the main air channel.

22. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetor sections with a throttle shaft assembly extending into the two carburetor sections, wherein the throttle shaft assembly comprises a shaft, a throttle plate attached to the shaft and a channel in the shaft, and wherein the throttle plate is located at a first one of the carburetor sections and the channel of the shaft is located at a second one of the carburetor sections.

23. A carburetor system for use with an internal combustion engine, the carburetor system comprising:

a first carburetor section;

a second carburetor section; and a common throttle shaft assembly extending through both the first and second carburetor sections, the shaft assembly comprising a throttle plate located in a main air passageway of the first carburetor section and a throttle shaft having the throttle plate connected thereto, the throttle shaft extending into a channel in the second carburetor section and being rotatable to increase and decrease a flow path through the channel as the shaft is rotated.

24. A carburetor system as in claim 23 further comprising a common choke shaft assembly extending through both the first and second carburetor sections.

25. A carburetor system as in claim 24 wherein the choke shaft assembly comprises a choke shaft and a choke plate attached to the choke shaft, the choke plate being located in the main air passage of the first carburetor section and the choke shaft extending into the channel of the second carburetor section.

26. A carburetor system as in claim 25 wherein the choke shaft comprises a through-hole which can be aligned with and misaligned with the channel of the second carburetor section as the choke shaft is rotated.

27. A carburetor system as in claim 23 wherein the throttle shaft assembly extends through an air bleed conduit through a frame of the carburetor system and is adapted to at least partially open and close a path through the air bleed conduit when the throttle shaft is rotated.

28. A carburetor system as in claim 27 wherein the throttle shaft assembly extends through an accelerator pump conduit in the frame and is adapted to at least partially open and close a path through the accelerator pump conduit when the throttle shaft is rotated.

29. A carburetor system as in claim 23 wherein the throttle shaft comprises at least one through-hole extending through the shaft at the channel which can be at least partially aligned and misaligned with the channel as the shaft is rotated.

30. A carburetor system as in claim 29 wherein the through-hole comprises a cross-sectional size which is about the same as a cross-sectional size of the channel.

31. A carburetor system as in claim 29 wherein the throttle shaft further comprises a groove on an exterior of the shaft in the channel.

32. A carburetor system as in claim 29 wherein the throttle shaft comprises at least two of the through holes having different sizes.

33. A method of controlling delivery of fuel/air mixtures in a carburetor system for an internal combustion engine, the method comprising steps of:

providing the carburetor system with two carburetor sections for creating two different fuel/air mixtures and a common control shaft assembly which extends through two separate conduits in the respective two carburetor sections; and rotating the common control shaft assembly to open or restrict pathways through the two conduits, wherein a first one of the conduits is smaller than a second one of the conduits, and wherein the control shaft comprises a plate attached to the control shaft in the first conduit and a hole through the control shaft at the second conduit, wherein the hole can be aligned with and misaligned with the second conduit when the control shaft is rotated to open or restrict the pathway through the hole and the second conduit.

34. A method as in claim 33 wherein the step of rotating the control shaft assembly opens or restricts an air bleed conduit and an accelerator pump conduit in a frame of the carburetor system.

35. A method as in claim 33 further comprising rotating a second common control shaft to open or restrict the pathways through the two conduits, wherein the second control shaft comprises a second plate attached to the second control shaft in the first conduit and a second hole through the second control shaft at the second conduit, wherein the second hole of the second control shaft can be aligned with and misaligned with the second conduit when the second control shaft is rotated to open or restrict the pathway through the second hole and the second conduit.

36. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetor sections with a throttle shaft assembly and a choke shaft assembly, each of the two carburetor sections having a respective air flow channel, and each of the shaft assemblies extending into both of the two air flow channels of the two carburetor sections.

37. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetor sections with a throttle shaft assembly and a choke shaft assembly operably connected to two air flow channels of the two carburetor sections, wherein a first one of the air flow channels has a smaller cross-sectional flow path than a second one of the air flow channels.

38. An engine as in claim 37 wherein at least one of the shaft assemblies comprises a shaft with a pathway through the shaft located at a second one of the air flow channels which can be aligned with and misaligned with the second air flow channel when the shaft is rotated.

39. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetor sections with a throttle shaft assembly and a choke shaft assembly operably connected to two air flow channels of the two carburetor sections, wherein a first one of the air flow channels is connected to a crankcase of the engine and a second one of the air flow channels is connected to an accumulator extending between the crankcase and a cylinder of the engine.

40. A two-stroke internal combustion engine comprising:

a crankcase;

a cylinder connected to the crankcase;

a fuel delivery system connected to the cylinder;

a reciprocating piston movably located in the cylinder; and a combined air throttle and crankcase lubrication system for supplying combined air and lubricant into the crankcase of the engine, wherein the fuel delivery system delivers a majority of fuel directly to a combustion chamber of the cylinder without passing the majority of fuel through the crankcase, and wherein the air supplied to the crankcase with the lubricant is subsequently used to scavenge burned gases from the combustion chamber.

* * * * *